US008985075B2

(12) United States Patent
Tadokoro et al.

(10) Patent No.: US 8,985,075 B2
(45) Date of Patent: Mar. 24, 2015

(54) VALVE TIMING CONTROL SYSTEM OF INTERNAL COMBUSTION ENGINE

(71) Applicant: Hitachi Automotive Systems, Ltd., Hitachinaka-shi, Ibaraki (JP)

(72) Inventors: Ryo Tadokoro, Atsugi (JP); Shinichi Kawada, Isehara (JP); Atsushi Yamanaka, Atsugi (JP); Hiroyuki Nemoto, Hitachi (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 0 days.

(21) Appl. No.: 14/173,291

(22) Filed: Feb. 5, 2014

(65) Prior Publication Data

US 2014/0216372 A1 Aug. 7, 2014

(30) Foreign Application Priority Data

Feb. 7, 2013 (JP) ..... 2013-021947

(51) Int. Cl.
*F01L 1/34* (2006.01)
*F01L 13/00* (2006.01)

(52) U.S. Cl.
CPC ..... *F01L 1/34* (2013.01); *F01L 2013/103* (2013.01)
USPC ..... 123/90.17; 123/90.11; 123/90.15; 251/129.01; 251/129.15

(58) Field of Classification Search
CPC . F01L 9/04; F01L 2009/04; F01L 2009/0411; F01L 2013/103
USPC ..... 123/90.11, 90.15, 90.17; 251/129.01, 251/129.15
See application file for complete search history.

(56) References Cited

U.S. PATENT DOCUMENTS

| | | | | |
|---|---|---|---|---|
| 7,603,223 | B2 | 10/2009 | Moriya | |
| 7,938,088 | B2 * | 5/2011 | Mashiki et al. | 123/90.15 |
| 7,959,537 | B2 | 6/2011 | Sugiura et al. | |
| 2009/0017952 | A1 | 1/2009 | Sugiura et al. | |
| 2009/0048758 | A1 | 2/2009 | Moriya | |

FOREIGN PATENT DOCUMENTS

| | | | |
|---|---|---|---|
| JP | 2006-207398 | A | 8/2006 |
| JP | 2009-013964 | A | 1/2009 |

* cited by examiner

*Primary Examiner* — Ching Chang
(74) *Attorney, Agent, or Firm* — Foley & Lardner LLP

(57) ABSTRACT

In a valve timing control system of an internal combustion engine employing both an electric-motor-driven intake valve timing control device for changing intake valve timing and an electric-motor-driven exhaust valve timing control device for changing exhaust valve timing, the intake valve timing control device includes a less-friction roller speed reducer having a toothed gear and configured to transmit torque by repeated relocations of each of rollers rolling and relocating from one of two adjacent teeth of the toothed gear to the other. In contrast, the exhaust valve timing control device includes a planetary-gear speed reducer having a friction greater than a friction of the roller speed reducer and configured to transmit torque by meshed-engagement of toothed gears in mesh with each other.

7 Claims, 11 Drawing Sheets

VALVE TIMING CONTROL SYSTEM OF INTERNAL COMBUSTION ENGINE

TECHNICAL FIELD

The present invention relates to a valve timing control system of an internal combustion engine for variably controlling valve timings (i.e., valve open timing and valve closure timing) of intake and exhaust valves.

BACKGROUND ART

A valve timing control system, which is configured to change an angular phase of a camshaft relative to a timing sprocket by virtue of hydraulic pressure, is generally known. In recent years, there have been proposed and developed various valve timing control systems in which an angular phase of a camshaft relative to a timing sprocket that is configured to rotate in synchronism with rotation of an engine crankshaft is changed by transmitting rotary motion (torque) of an electric motor through a speed reducer to the camshaft, so as to variably control intake-valve timing and exhaust-valve timing.

One such valve timing control system has been disclosed in Japanese Unexamined Patent Application Publication No. 2006-207398 (hereinafter is referred to as "JP2006-207398"), corresponding to U.S. Pat. No. 7,603,223, issued on Oct. 13, 2009. In the valve timing control system disclosed in JP2006-207398, two electric-motor-driven valve timing control devices are mounted respectively on the intake camshaft and the exhaust camshaft.

SUMMARY OF THE INVENTION

In the valve timing control system as disclosed in JP2006-207398, the intake valve timing control device tends to frequently operate over the entire engine operating range after the internal combustion engine has been started. In contrast, in the case of the exhaust valve timing control device, valve timing (an angular phase of the exhaust camshaft relative to the sprocket) is often held constant within an engine operating range except middle engine speeds. Therefore, the intake valve timing control device requires the improved operational responsiveness to a valve-timing change (an angular phase shift of the intake camshaft relative to the sprocket), whereas the exhaust valve timing control device requires the improved phase holding performance for a phase angle of the exhaust camshaft relative to the sprocket.

However, in the case of the valve timing control system disclosed in JP2006-207398, the speed reducers are the same in the intake valve timing control device and the exhaust valve timing control device. For the reasons discussed above, assuming that a higher priority is put on the operational responsiveness, the phase holding performance tends to deteriorate. Conversely, assuming that a higher priority is put on the phase holding performance, the operational responsiveness tends to deteriorate. There is a problem that two contradictory requirements (i.e., the improved operational responsiveness and the improved phase holding performance) cannot be balanced.

Accordingly, it is an object of the invention to provide a valve timing control system of an internal combustion engine, configured to reconcile and balance two contradictory requirements, that is, the improved operational responsiveness of an intake valve timing control device and the improved phase holding performance of an exhaust valve timing control device.

In order to accomplish the aforementioned and other objects of the present invention, a valve timing control system of an internal combustion engine, comprises an electric-motor-driven intake valve timing control device installed on an intake camshaft, the intake valve timing control device comprising a first electric motor provided to generate torque by energizing the first electric motor, and a first speed reducer configured to reduce a rotational speed of the first electric motor, and transmit the reduced rotational speed to the intake camshaft for changing intake valve timing, and an electric-motor-driven exhaust valve timing control device installed on an exhaust camshaft, the exhaust valve timing control device comprising a second electric motor provided to generate torque by energizing the second electric motor, and a second speed reducer configured to reduce a rotational speed of the second electric motor, and transmit the reduced rotational speed to the exhaust camshaft for changing exhaust valve timing, wherein the first speed reducer of the intake valve timing control device is configured to have a friction less than a friction of the second speed reducer of the exhaust valve timing control device.

According to another aspect of the invention, a valve timing control system of an internal combustion engine, comprises an electric-motor-driven intake valve timing control device installed on an intake camshaft, the intake valve timing control device comprising a first electric motor provided to generate torque by energizing the first electric motor, and a first speed reducer having a first toothed gear configured to reduce a rotational speed of the first electric motor, and transmit the reduced rotational speed to the intake camshaft for changing intake valve timing, and an electric-motor-driven exhaust valve timing control device installed on an exhaust camshaft, the exhaust valve timing control device comprising a second electric motor provided to generate torque by energizing the second electric motor, and a second speed reducer having a second toothed gear configured to reduce a rotational speed of the second electric motor, and transmit the reduced rotational speed to the exhaust camshaft for changing exhaust valve timing, wherein the first speed reducer of the intake valve timing control device is configured to transmit torque by repeated relocations of each of rolling elements rolling and relocating from one of two adjacent teeth of the first toothed gear to the other, and the second speed reducer of the exhaust valve timing control device is configured to transmit torque by meshed-engagement of the second toothed gear with another toothed gear.

According to a further aspect of the invention, a valve timing control system of an internal combustion engine, comprises an electric-motor-driven intake valve timing control device installed on an intake camshaft, the intake valve timing control device comprising a first electric motor provided to generate torque by energizing the first electric motor, and a first speed reducer configured to reduce a rotational speed of the first electric motor, and transmit the reduced rotational speed to the intake camshaft for changing intake valve timing, and an electric-motor-driven exhaust valve timing control device installed on an exhaust camshaft, the exhaust valve timing control device comprising a second electric motor provided to generate torque by energizing the second electric motor, and a second speed reducer configured to reduce a rotational speed of the second electric motor, and transmit the reduced rotational speed to the exhaust camshaft for changing exhaust valve timing, wherein a cogging torque of the first electric motor of the intake valve timing control device is set to be less than a cogging torque of the second electric motor of the exhaust valve timing control device.

According to a still further aspect of the invention, a valve timing control system of an internal combustion engine, comprises an electric-motor-driven intake valve timing control device installed on an intake camshaft, the intake valve timing control device comprising a first electric motor provided to generate torque by energizing the first electric motor, and a first speed reducer configured to reduce a rotational speed of the first electric motor, and transmit the reduced rotational speed to the intake camshaft for changing intake valve timing, and an electric-motor-driven exhaust valve timing control device installed on an exhaust camshaft, the exhaust valve timing control device comprising a second electric motor provided to generate torque by energizing the second electric motor, and a second speed reducer configured to reduce a rotational speed of the second electric motor, and transmit the reduced rotational speed to the exhaust camshaft for changing exhaust valve timing, wherein the first electric motor of the intake valve timing control device is constructed by a brushless motor, and the second electric motor of the exhaust valve timing control device is constructed by a brush-equipped direct-current motor.

The other objects and features of this invention will become understood from the following description with reference to the accompanying drawings.

DESCRIPTION OF THE PREFERRED EMBODIMENTS

First Embodiment

Figure 1:
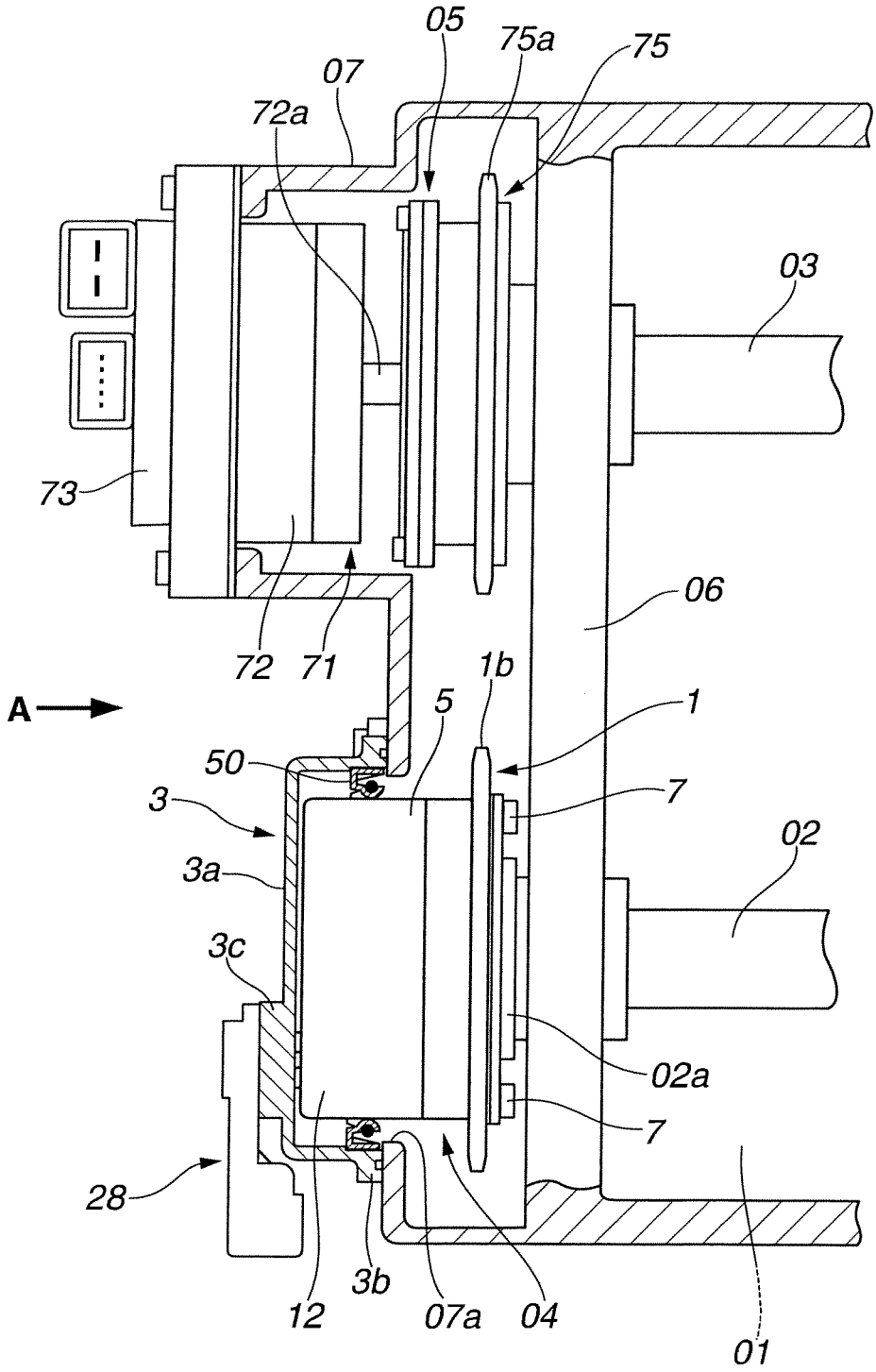
FIG. 1 is a plan view illustrating the essential part of the first embodiment of a valve timing control system.
Figure 2:
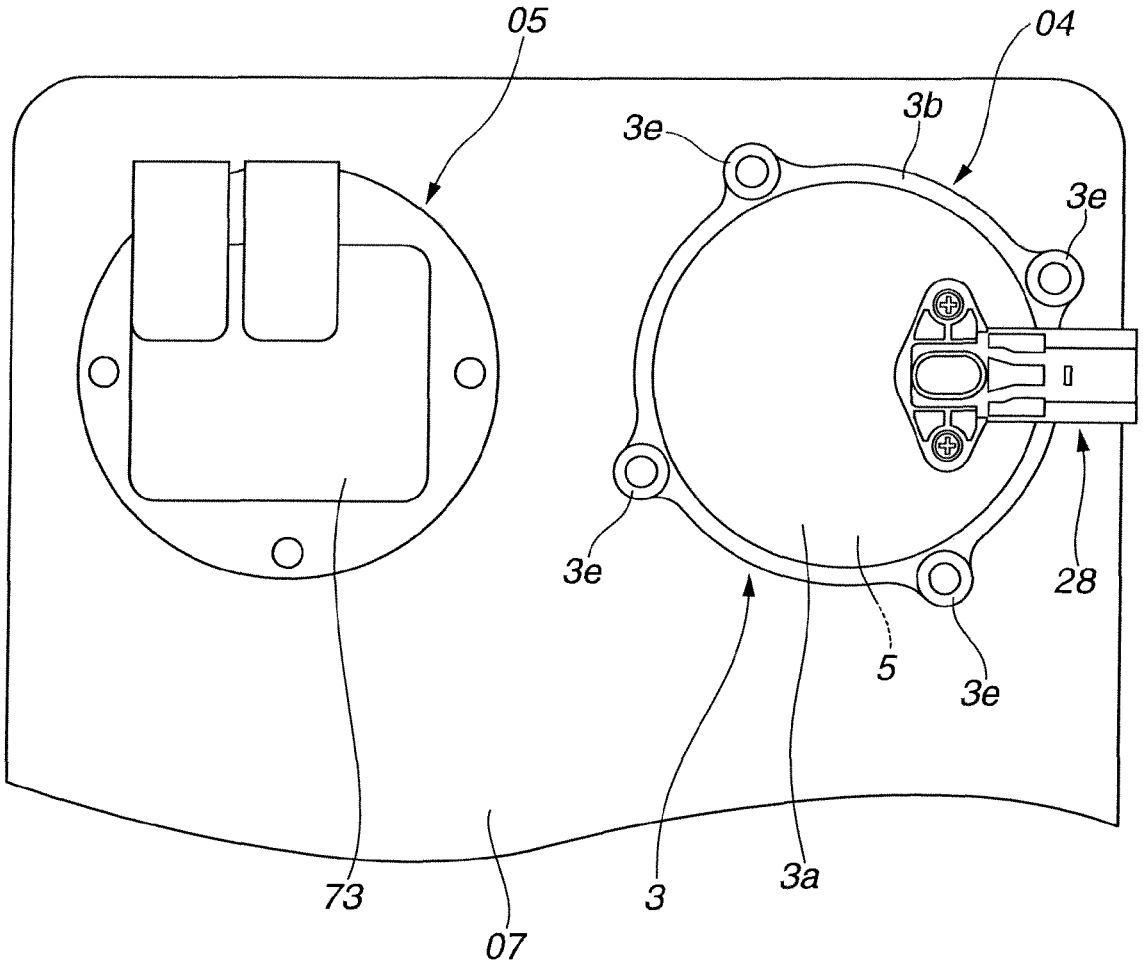
FIG. 2 is a view taken in the direction of the arrow A of FIG. 1.

Referring now to the drawings, particularly to FIGS. 1-2, the valve timing control system of the first embodiment includes an intake camshaft 02 rotatably supported on a cylinder head 01 through camshaft-journal bearing members 06 fixedly connected onto the upper deck of cylinder head 01, an exhaust camshaft 03 rotatably supported on the cylinder head 01 through the camshaft-journal bearing members 06 and arranged parallel to the intake camshaft 02, an electric-motor-driven intake valve timing control device (hereinafter referred to as "intake VTC") 04 installed on the front end of intake camshaft 02, and an electric-motor-driven exhaust valve timing control device (hereinafter referred to as "exhaust VTC") 05 installed on the front end of exhaust camshaft 03.

Each of camshaft-journal bearing members 06 is made from aluminum alloy. The front-end camshaft-journal bearing member 06 is formed integral with a chain cover 07 configured to partially cover both the intake VTC 04 and the exhaust VTC 05. A cover member 3 is bolted to a part of the chain cover 07 on the side of intake VTC 04 for hermetically covering the front end of intake VTC 04.

[Intake VTC]

Figure 3:
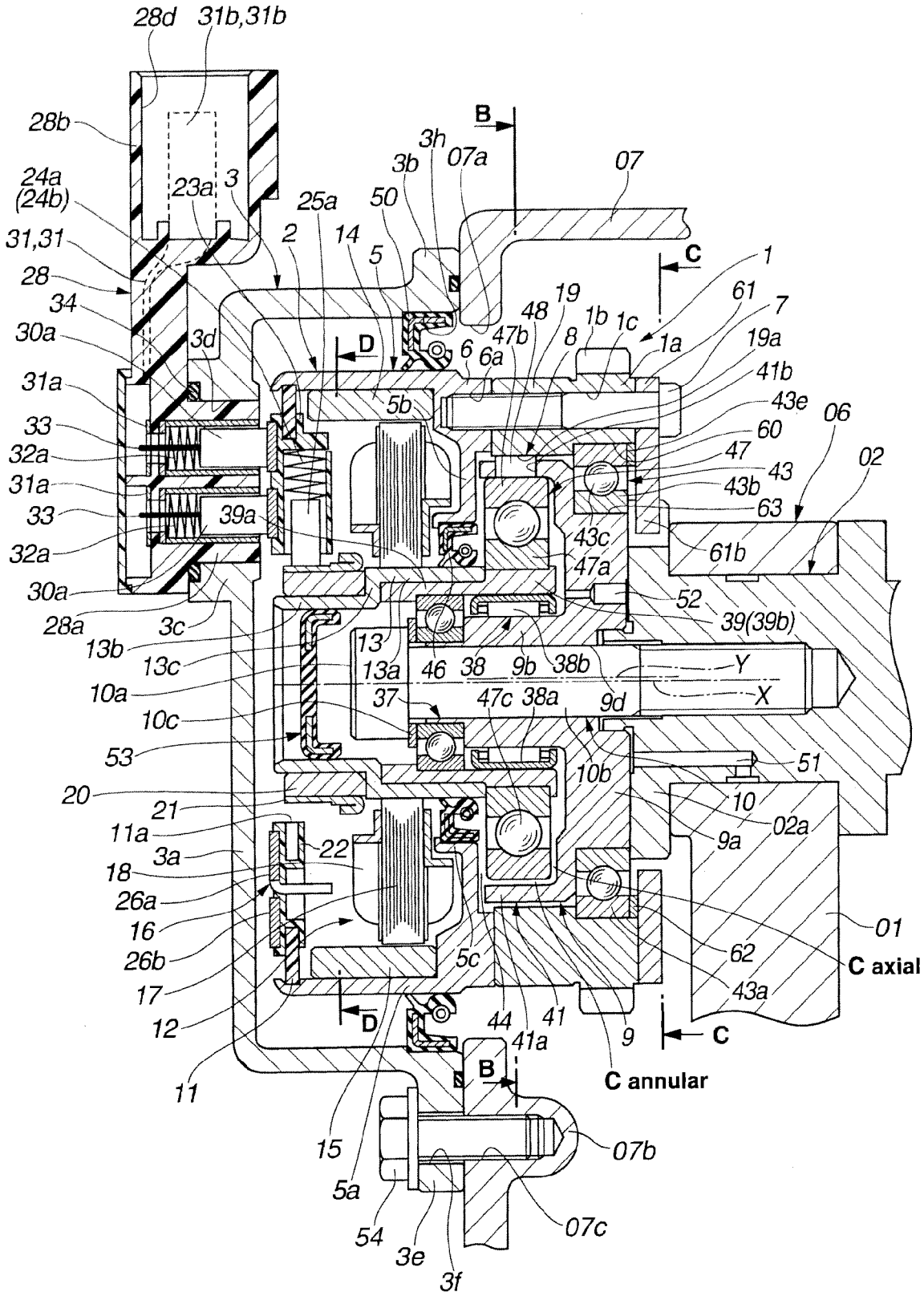
FIG. 3 is a longitudinal cross-sectional view illustrating an intake valve timing control (VTC) device of the first embodiment.
Figure 4:
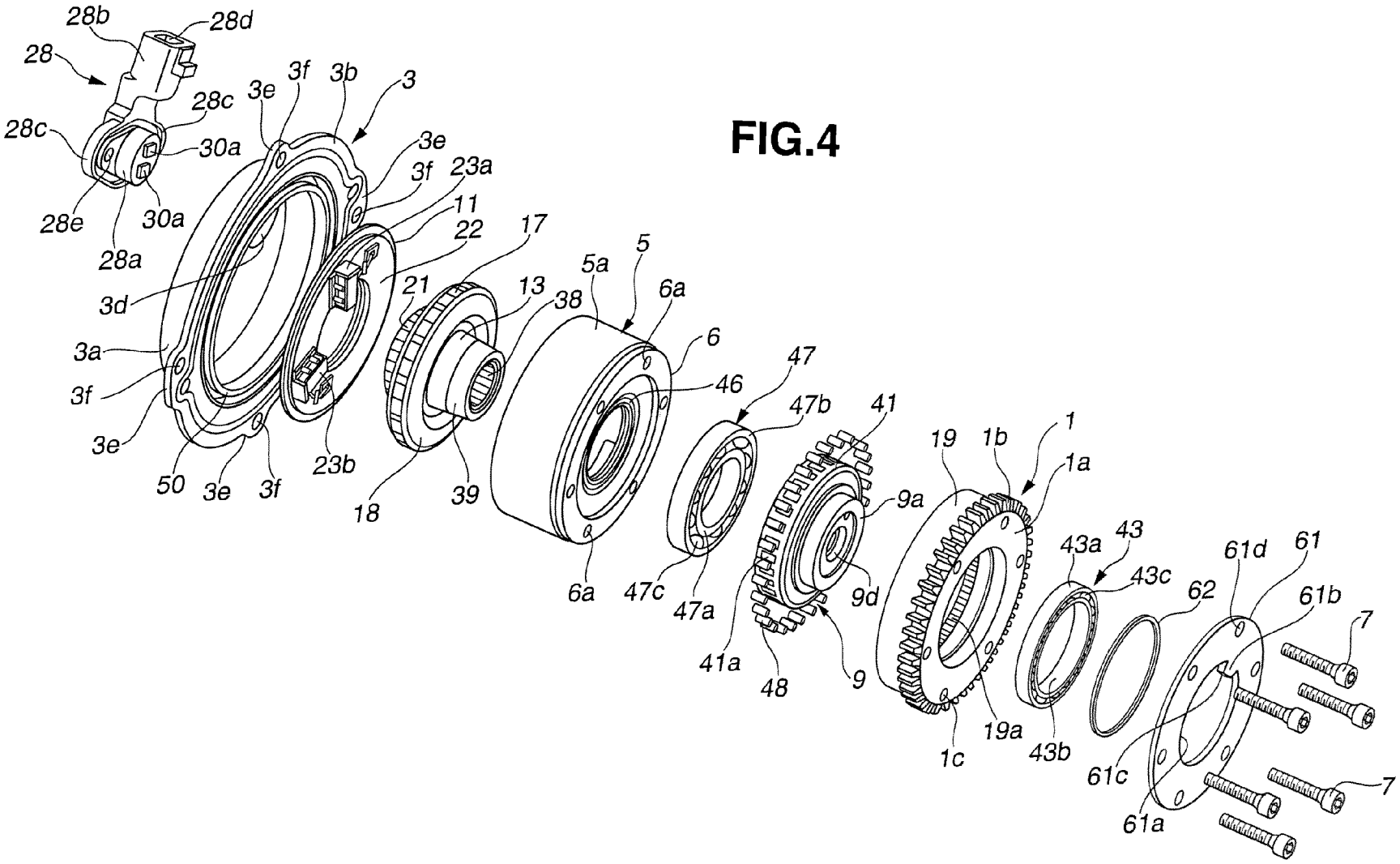
FIG. 4 is a perspective disassembled view illustrating major component parts constructing the VTC device of the first embodiment.

As shown in FIGS. 3-4, the above-mentioned intake VTC 04 is comprised of a sprocket 1 (serving as a driving rotary member) that rotates in synchronism with rotation of an engine crankshaft, and a phase change mechanism (a phase converter) 2 (see FIG. 3) installed between the sprocket 1 and the intake camshaft 02 for changing a relative angular phase between the sprocket 1 and the intake camshaft 02 depending on an engine operating condition.

Sprocket 1 is comprised of an annular sprocket body 1*a*, a timing gear 1*b* formed integral with the outer periphery of sprocket body 1*a*, and an internal-tooth structural member 19. Sprocket body 1*a* is made from iron-based metal material, and formed with a stepped inner peripheral portion and formed integral with the timing gear 1*b*. Timing gear 1*b* receives torque from the crankshaft through a timing chain (not shown) wound on both a sprocket on the crankshaft and the sprocket 1 on the intake camshaft. Internal-tooth structural member 19 is formed integral with the front end of sprocket body 1*a*.

Also, sprocket 1 is rotatably supported by a large-diameter ball bearing 43 interleaved between the sprocket body 1*a* and a driven rotary member, simply, a driven member 9 (described later) fixedly connected to the front end of intake camshaft 02, so as to permit rotary motion of intake camshaft 02 relative to sprocket 1.

Large-diameter ball bearing 43 is comprised of an outer ring 43*a*, an inner ring 43*b*, and balls 43*c* confined between outer and inner rings 43*a*-43*b*. The outer ring 43*a* is fixed to the inner periphery of sprocket body 1*a*, whereas the inner ring 43*b* is fixed to the outer periphery of driven member 9 (described later).

Sprocket body 1*a* has an outer-ring retaining annular groove 60 formed and cut in its inner peripheral surface. Outer-ring retaining annular groove 60 is formed as a shouldered annular groove into which the outer ring 43*a* of large-diameter ball bearing 43 is axially press-fitted. The shouldered portion of outer-ring retaining annular groove 60 serves to position one axial end face (i.e., a forward end face, viewing FIG. 3) of the outer ring 43*a* in place.

Internal-tooth structural member 19 is formed integral with the circumference of the front end of sprocket body 1*a*, and formed into a cylindrical shape extended toward an electric motor 12 (described later) of phase converter 2. Internal-tooth structural member 19 is formed on its inner periphery with a plurality of waveform internal teeth 19*a*. The annular rear end face of an annular female screw-threaded member 6, formed integral with a housing 5 (described later), and the annular front end face of internal-tooth structural member 19 are arranged to be axially opposed to each other.

An annular retainer plate 61 is located at the rear end of sprocket body 1*a*, facing apart from the internal-tooth structural member 19. Retainer plate 61 is made from a metal plate. As shown in FIG. 3, the outside diameter of retainer plate 61 is dimensioned to be approximately equal to that of the sprocket body 1*a*. The inside diameter of retainer plate 61 is set or dimensioned to be less than the inside diameter of the outer ring 43*a* of ball bearing 43 and also dimensioned to be approximately equal to the outside diameter of the inner ring 43*b* of ball bearing 43.

Hence, the inner peripheral portion 61*a* (see FIG. 4) of retainer plate 61 is arranged to be axially opposed to the rearward end face 43*e* of the outer ring 43*a* of ball bearing 43 with a given clearance space in such a manner as to cover the rearward end face 43*e* of the outer ring 43*a*. Also, the inner peripheral portion 61*a* of annular retainer plate 61 has a radially-inward protruding stopper 61*b* integrally formed at a given circumferential angular position of the inner peripheral portion 61*a*.

Figure 6:
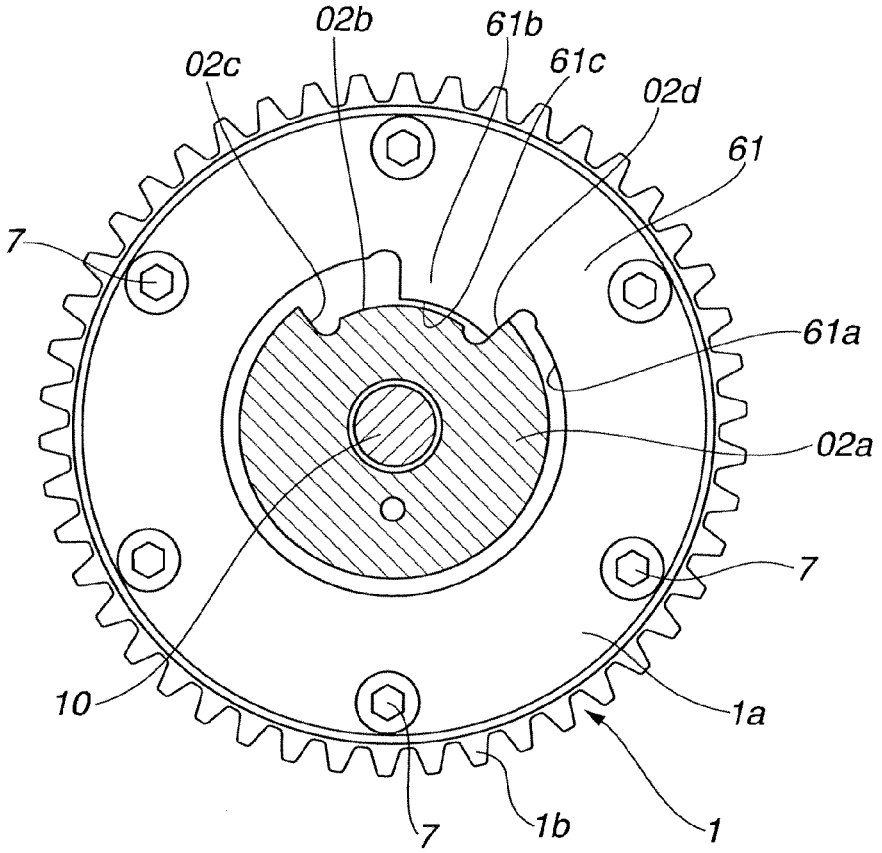
FIG. 6 is a lateral cross section taken along the line C-C of FIG. 3.

As seen in FIG. 6, the radially-inward protruding stopper 61*b* is formed into a substantially sector. The innermost edge 61*c* of stopper 61*b* is configured to be substantially conformable to a shape of the circular-arc peripheral surface of a stopper groove 02*b* (described later) of the front end of camshaft 02. The outer peripheral portion of retainer plate 61 is formed with circumferentially equidistant-spaced, six bolt insertion holes 61*d* (through holes) through which bolts 7 are inserted.

Furthermore, an annular spacer 62 is interleaved between the inside face (the left-hand side face) of retainer plate 61 and the rearward end face 43*e* of the outer ring 43*a* of ball bearing 43. Spacer 62 is provided for applying a slight push from the inside face of retainer plate 61 to the rearward end face 43*e* of the outer ring 43*a*, when the annular female screw-threaded member 6 (housing 5), the sprocket 1, and the retainer plate 61 are integrally connected to each other by fastening them together with bolts 7.

In a similar manner to the six bolt insertion holes 61*d* (through holes) formed in the retainer plate 61, the outer peripheral portion of sprocket body 1*a* (internal-tooth structural member 19) is formed with circumferentially equidistant-spaced, six bolt insertion holes 1*c* (through holes). On the other hand, the annular female screw-threaded member 6 is formed with six female screw threads 6*a* configured to be conformable to respective circumferential positions of bolt insertion holes 1*c* (bolt insertion holes 61*d*). Hence, the annular female screw-threaded member 6 (the housing 5), the sprocket 1, and the retainer plate 61 are integrally connected to each other by axially fastening them together with bolts 7.

Outside diameters of the sprocket body 1*a*, the internal-tooth structural member 19, the retainer plate 61, and the female screw-threaded member 6 are dimensioned to be almost the same.

As shown in FIGS. 1 and 3, chain cover 07 is laid out and bolted to an engine body in a manner so as to vertically extend for covering the timing chain (not shown) wound on the sprocket. Chain cover 07 has a substantially circular opening 07*a* configured to be conformable to the contour of intake VTC 04. The opening 07*a* is formed in the annular wall of the front end of chain cover 07. The annular wall has four boss sections 07*b* integrally formed on the inner periphery of the annular wall and circumferentially spaced from each other. Four female screw-threads 07*c* are machined in respective boss sections 07*b* such that female screw-threads 07*c* extend from the front end face of the annular wall into the respective boss sections.

As shown in FIGS. 1 and 3, cover member 3 is made from aluminum alloy and formed into a substantially cup shape. Cover member 3 is comprised of a cup-shaped cover main body 3*a* and an annular flange 3*b* formed integral with the circumference of the right-hand side opening end (viewing FIG. 1) of cover main body 3*a*. Cover main body 3*a* is configured to cover the front end of phase converter 2. Cover main body 3*a* has a slightly axially-extending cylindrical wall portion 3*c* integrally formed at a given position deviated upward from the center of the frontal flat wall portion of cover main body 3*a*. The cylindrical wall portion 3*c* has a retaining through-hole 3*d* formed therein.

Annular flange 3*b* is integrally formed with four tab-like portions 3*e*, circumferentially spaced apart from each other at intervals of approximately 90 degrees. Four bolt insertion holes 3*f* (through holes) are bored in respective tab-like portions 3*e* of the annular flange 3*b*. Cover member 3 is fixedly connected to the chain cover 07 by means of bolts 54, which are inserted through the respective bolt insertion holes 3*f* and screwed into the female screw-threads 07*c* formed in the respective boss sections 07*b* of chain cover 07.

Also, the inner periphery of the right-hand side opening end (viewing FIG. 3) of cover main body 3*a* is formed as a shouldered oil-seal retaining annular groove 3*h*. A large-diameter oil seal 50 is interleaved between the shouldered oil-seal retaining annular groove 3*h* of cover main body 3*a* and the outer peripheral surface of housing 5. Large-diameter oil seal 50 is formed into a substantially C-shape in lateral cross section. Oil seal 50 is made from synthetic rubber (a base material), and also a core metal is buried in the base material. The cylindrical outer peripheral surface of oil seal 50 is fitted to the shouldered oil-seal retaining annular groove 3*h* of cover main body 3*a* in a fluid-tight fashion, whereas the inner periphery of oil seal 50 (that is, a spring-loaded single lip and a non-spring-loaded dust lip) is fitted onto the outer periphery of housing 5 in a fluid-tight fashion.

As shown in FIGS. 3-4, housing 5 is comprised of a housing main body 5*a* made from iron-based metal material and formed into a substantially cylindrical shape with a rear end face (a bottom face) by pressing, and a seal plate 11 made from synthetic resin (non-magnetic material) and provided for sealing the axially forward opening (the left-hand side opening end, viewing FIG. 3) of housing main body 5*a*.

Housing main body 5*a* has a bottom 5*b* formed at its rear end. Housing main body 5*a* is formed in a substantially center of the bottom 5*b* with a large-diameter eccentric-shaft insertion hole into which an eccentric shaft 39 (described later) is inserted. An axially-leftward extending cylindrical portion 5*c* is formed integral with the annular edge of the eccentric-shaft insertion hole in a manner so as to somewhat extend in the axial direction of intake camshaft 02. The previously-discussed annular female screw-threaded member 6 is formed integral with the outer periphery of the bottom 5*b* of housing 5.

Intake camshaft 02 has two rotary drive cams (per cylinder) integrally formed on its outer periphery for operating the associated two intake valves (not shown) per one engine cylinder. Also, intake camshaft 02 has a flanged portion 02*a* integrally formed at its front end. As seen in FIG. 3, the outside diameter of flanged portion 02*a* is dimensioned to be slightly greater than that of a fixed-end portion 9*a* of driven member 9 (described later). Hence, after installation of all component parts, the circumference of the front end face of the flanged portion 02*a* of intake camshaft 02 is brought into abutted-engagement with the rearward end face of the inner ring 43*b* of large-diameter ball bearing 43. Driven member 9 is fixedly connected to the front end of the flanged portion 02*a* by means of a cam bolt 10 under a condition where the front end face of the flanged portion 02*a* has been kept in abutted-engagement with the rear end face of the fixed-end portion 9*a* of driven member 9.

As shown in FIG. 6, the outer periphery of the flanged portion 02*a* of intake camshaft 02 is partially machined or cut as the stopper groove 02*b* recessed along the circumferential direction. The radially-inward protruding stopper 61*b* of retainer plate 61 is circumferentially moveably installed in the stopper groove 02*b*. Stopper groove 02*b* is formed into a circular-arc shape having a specified circumferential length to permit a circumferential movement of stopper 61*b* within a limited motion range determined based on the specified circumferential length. Hence, a maximum phase-advance position of intake camshaft 02 relative to sprocket 1 is restricted by abutment between the counterclockwise edge of stopper 61*b* and the clockwise edge 02*c* of stopper groove 02*b*. On the other hand, a maximum phase-retard position of intake camshaft 02 relative to sprocket 1 is restricted by abutment between the clockwise edge of stopper 61*b* and the counterclockwise edge 02*d* of stopper groove 02*b*.

As appreciated from the longitudinal cross section of FIG. 3, stopper 61*b* is kept in a spaced, contact-free relationship with the fixed-end portion 9*a* of driven member 9 in the axial direction, thus adequately suppressing undesirable interference between the stopper 61*b* and the fixed-end portion 9*a*.

As appreciated from the longitudinal cross section of FIG. 3, cam bolt 10 is comprised of a head 10*a* and a shank 10*b* formed integral with each other, and an annular washer provided at the boundary of head 10*a* and shank 10*b*. Shank 10*b* is formed on its outer periphery with a male-screw-threaded portion, which is screwed into a female-screw-threaded portion machined into the front end of intake camshaft 02 along the axis of intake camshaft 02.

Driven member 9 is made from iron-based metal material. As seen from the longitudinal cross section of FIG. 3, the driven member 9 is comprised of the disk-shaped fixed-end portion 9*a*, an axially-forward-extending cylindrical portion 9*b* formed integral with the front end face of disk-shaped fixed-end portion 9*a*, and a substantially cylindrical cage 41, which cage is formed integral with the outer periphery of disk-shaped fixed-end portion 9*a* and configured to serve as a roller holder for holding a plurality of rollers 48 (rolling elements).

The rear end face of disk-shaped fixed-end portion 9*a* is arranged to abut with the front end face of the flanged portion 02*a* of intake camshaft 02, and fixedly connected to the flanged portion 02*a* by an axial force of cam bolt 10.

As shown in FIG. 3, cylindrical portion 9*b* is formed with a central bore 9*d* into which the shank 10*b* of cam bolt 10 is inserted. A needle bearing 38 is mounted on the outer periphery of cylindrical portion 9*b*.

Figure 5:
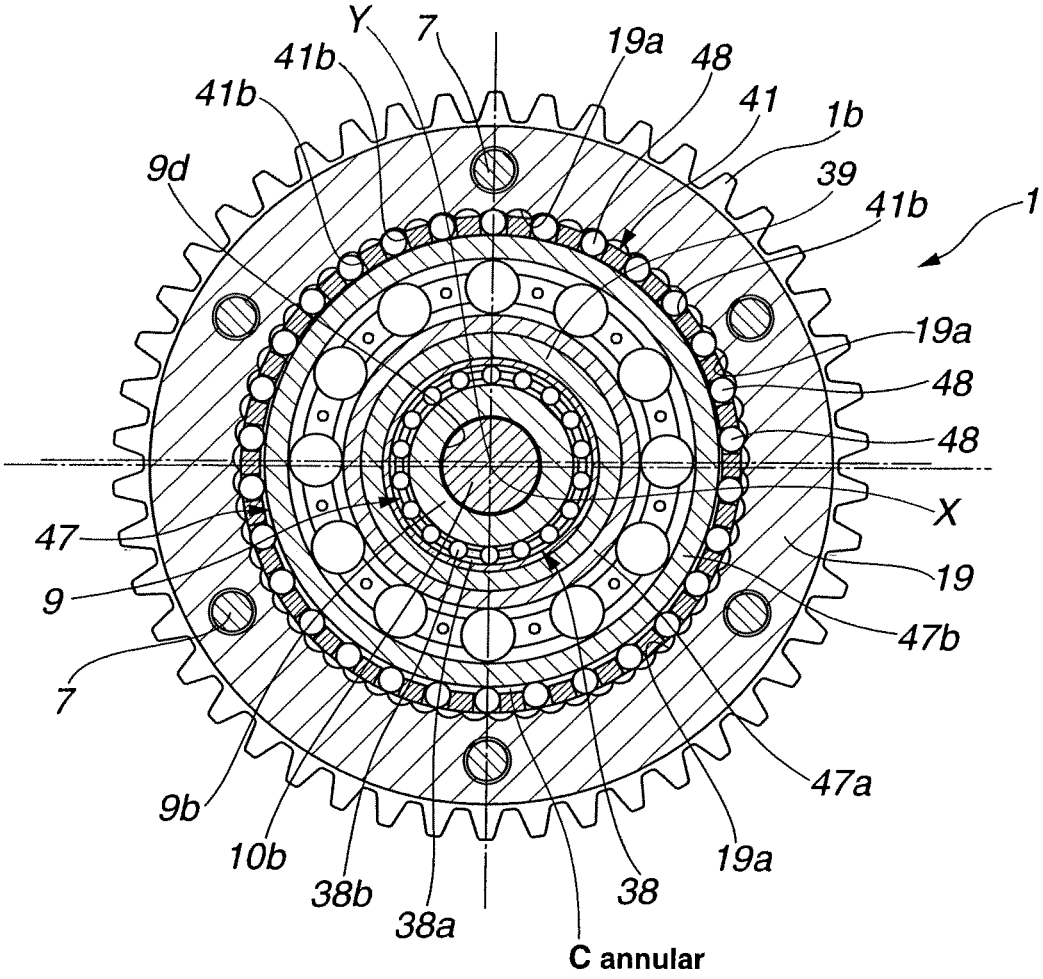
FIG. 5 is a lateral cross section taken along the line B-B of FIG. 3.

As shown in FIGS. 3-5, cage 41 (the roller holder) is configured to further extend from the outer periphery of disk-shaped fixed-end portion 9*a*, and bent into a substantially L shape in longitudinal cross section and formed into a substantially cylindrical shape extending in the same axial direction as the cylindrical portion 9*b* and having an annular bottom axially opposed to one sidewall of a ball-bearing outer ring 47*b* (described later). More concretely, the substantially cylindrical portion 41*a* of cage 41 is configured to extend toward the bottom 5*b* of housing 5 through an annular internal space 44 defined between the annular female screw-threaded member 6 and the axially-leftward extending cylindrical portion 5*c*. Also, the substantially cylindrical portion 41*a* of cage 41 has a plurality of axially-protruding lugs. As a whole, the axially-protruding lugs are shaped into a substantially comb-tooth shape. That is, by virtue of the axially-protruding lugs, each having a substantially rectangular cross-section, a plurality of roller-holding holes 41*b* are configured to be equidistant-spaced from each other with a given circumferential interval in the circumferential direction of the outer periphery of disk-shaped fixed-end portion 9*a*. Rollers 48 are rotatably held or installed in respective roller-holding holes 41*b*. The substantially cylindrical portion 41*a* of cage 41 has one fewer roller-holding holes (in other words, one fewer rollers or one fewer axially-protruding lugs) than the number of internal teeth 19*a* of internal-tooth structural member 19.

An inner-ring retaining annular groove 63 is machined and defined between the outer periphery of disk-shaped fixed-end portion 9*a* and the annular bottom of cage 41 formed integral with each other, for retaining the inner ring 43*b* of large-diameter ball bearing 43.

Inner-ring retaining annular groove 63 is formed as a shouldered annular groove configured to be radially opposed to the outer-ring retaining annular groove 60 of sprocket body 1*a*. Inner-ring retaining annular groove 63 is comprised of a cylindrical outer peripheral surface extending in the axial direction of intake camshaft 02 and a radially-extending shouldered annular surface configured to extend radially outward from the innermost end of the cylindrical outer peripheral surface. When assembling, the inner ring 43*b* of ball bearing 43 is axially press-fitted onto the cylindrical outer peripheral surface. At the same time, the forward end face of the press-fitted inner ring 43*b* is brought into abutted-engagement with the shouldered annular surface of inner-ring retaining annular groove 63, to position one axial end face (the forward end face) of the inner ring 43*b* in place.

Phase converter 2 is mainly constructed by the electric motor 12 coaxially located at the front end of intake camshaft 02, and a roller speed reducer 8 provided for reducing the rotational speed of the motor output shaft 13 of electric motor 12 and for transmitting the reduced motor speed (in other words, the increased motor torque) to the intake camshaft 02.

As seen in FIGS. 3-4, electric motor 12 is a brush-equipped direct-current (DC) motor. Electric motor 12 is comprised of the housing 5 serving as a yoke and rotating together with the sprocket 1, the motor output shaft 13 rotatably installed in the housing 5, a pair of substantially semi-circular permanent magnets 14-15 fixedly connected onto the inner peripheral surface of housing 5, and a stator 16 fixed to the seal plate 11.

Motor output shaft 13 is formed into a shouldered cylindrical-hollow shape, and serves as an armature. Motor output shaft 13 is constructed by a large-diameter portion 13*a* of the intake-camshaft side and a small-diameter portion 13*b* of the brush-holder side through a shouldered portion 13*c* formed substantially at a midpoint of the axially-extending cylindrical-hollow motor output shaft. An iron-core rotor 17, having a plurality of magnetic poles, is fixedly connected onto the outer periphery of large-diameter portion 13*a*. Eccentric shaft 39 is axially press-fitted into the large-diameter portion 13*a*, in a manner so as to be axially positioned in place by the inside annular face of shouldered portion 13*c*.

An annular member 20 is press-fitted onto the outer periphery of small-diameter portion 13*b*. A commutator 21 is axially press-fitted onto the outer peripheral surface of annular member 20, in a manner so as to be axially positioned in place by the outside annular face of shouldered portion 13*c*.

Furthermore, a plug 53 is fixed or press-fitted to the inner peripheral surface of small-diameter portion 13*b*, for preventing or adequately suppressing undesirable leakage of lubricating oil, which oil is supplied into the cylindrical-hollow motor output shaft 13 and eccentric shaft 39 for lubrication of a ball bearing 37 (described later) as well as the previously-discussed needle bearing 38, to the outside.

Iron-core rotor 17 is formed by a magnetic material having a plurality of magnetic poles. The outer periphery of iron-core rotor 17 is constructed as a bobbin having slots on which coil windings of an electromagnetic coil 18 is wound.

On the other hand, commutator 21 is formed as a substantially annular shape and made from a conductive material. Commutator 21 is divided into a plurality of segments whose number is equal to the number of magnetic poles of iron-core rotor 17. Terminals of the coil winding (not shown) drawn out from electromagnetic coil 18 are electrically connected to each of segments of commutator 21. That is, the terminals of the coil winding are sandwiched and electrically connected to the hemmed section formed on the periphery of commutator 21.

As a whole, the substantially semi-circular permanent magnets 14-15 are formed into a cylindrical shape, and have a plurality of magnetic poles in the circumferential direction. The axial position of each of permanent magnets 14-15 is offset forward from the fixed position of iron-core rotor 17.

Figure 7:
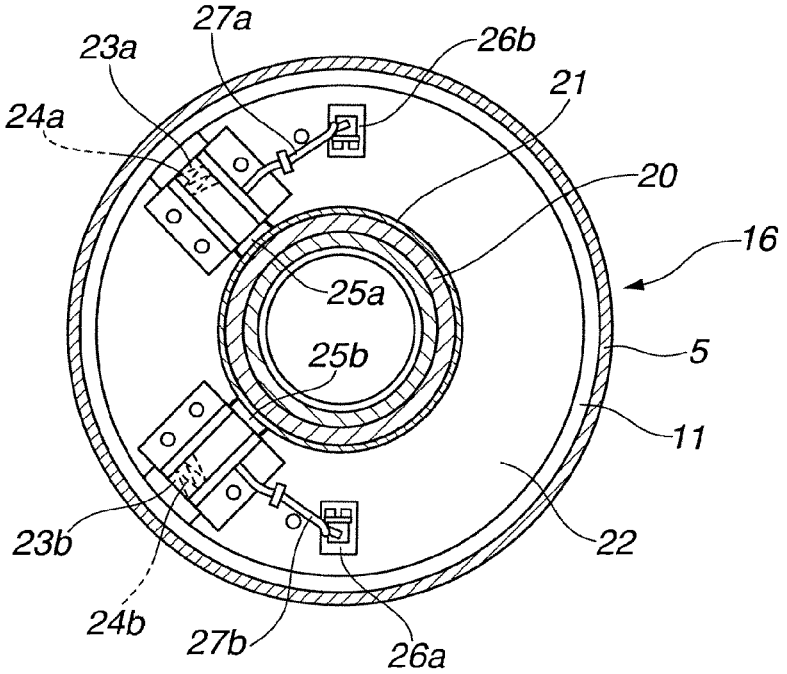
FIG. 7 is a lateral cross section taken along the line D-D of FIG. 3.

As shown in FIG. 7, stator 16 is mainly comprised of a disk-shaped synthetic-resin plate 22, a pair of synthetic-resin brush holders 23*a*-23*b*, a pair of first brushes 25*a*-25*b*, a radially-inside electricity-feeding slip ring 26*a*, a radially-outside electricity-feeding slip ring 26*b*, and pig-tale harnesses 27*a*-27*b*. Disk-shaped synthetic-resin plate 22 is integrally connected to the inner periphery of seal plate 11. Brush holders 23*a*-23*b* are attached onto the inside face of synthetic-resin plate 22. The first brushes 25*a*-25*b* serve as current-supply switching brushes and supported by respective holders 23*a*-23*b* so as to be radially slidable. The radially-inward ends of first brushes 25*a*-25*b* are kept in sliding-contact (elastic-contact or electric-contact) with the outer peripheral surface of commutator 21 by respective spring forces of coil springs 24*a*-24*b*. The radially-inside electricity-feeding slip ring 26*a* and the radially-outside electricity-feeding slip ring 26*b* are attached to the synthetic-resin plate 22, such that the outside face (the left-hand side face, viewing FIG. 3) of each of electricity-feeding slip rings 26*a*-26*b* is partially exposed and that the inside face (the right-hand side face, viewing FIG. 3) of each of slip rings 26*a*-26*b* is buried in the front end face of synthetic-resin plate 22. The first brush 25*a* and the electricity-feeding slip ring 26*b* are electrically connected to each other via the pig-tale harness 27*a*, whereas the first brush 25*b* and the electricity-feeding slip ring 26*a* are electrically connected to each other via the pig-tale harness 27*b*. The radially-inside annular slip ring 26*a* and the radially-outside annular slip ring 26*b* are laid out to be coaxial with each other with a given aperture.

The previously-discussed seal plate 11 is fitted into an annular groove cut in the inner periphery of the front end of the cylindrical housing main body 5*a* of housing 5, and fixedly connected to the front end of housing main body 5*a* in place by caulking. Also, the subassembly (11, 22) of seal plate 11 and disk-shaped synthetic-resin plate 22 is formed in its center with a shaft insertion hole 11*a* into which one axial end (the left-hand axial end, viewing FIG. 3) of motor output shaft 13 is partially inserted.

An integrally-molded synthetic-resin brush retainer 28 is fixedly connected to the cover main body 3*a*. As shown in FIGS. 3-4, brush retainer 28 is formed into a substantially L shape in side view. Brush retainer 28 is comprised of a substantially cylindrical brush-retaining portion 28*a*, a connector portion 28*b*, a pair of laterally-extending tab-like brackets 28*c*, 28*c* (see FIG. 4), and a pair of terminal strips 31, 31. Brush-retaining portion 28*a* is inserted into the retaining through-hole 3*d*. Connector portion 28*b* is formed integral with the upper end of brush-retaining portion 28*a*. Tab-like brackets 28*c*, 28*c* are formed integral with both sides of brush-retaining portion 28*a*. Most of terminal strips 31, 31 are buried in the synthetic-resin brush retainer 28.

Terminal strips 31, 31 are arranged parallel with each other in the vertical direction and partly cranked. One end (the downward terminal 31*a*) of each of the crank-shaped terminal strips 31 is exposed to the bottom of brush-retaining portion 28*a*. The other end (the upward terminal 31*b*) of each of terminal strips 31 is configured to protrude into a female fitting groove 28*d* of connector portion 28*b*. The upward terminals 31*b*, 31*b* of the two parallel terminal strips 31, 31 are electrically connected to a control unit (not shown) via a male socket (not shown) fitted to the female fitting groove 28*d*.

Brush-retaining portion 28*a* is configured to extend horizontally (axially). An upper hollow sleeve is press-fitted into an upper cylindrical-hollow through hole bored in the brush-retaining portion 28*a*. In a similar manner, a lower hollow sleeve is press-fitted into a lower cylindrical-hollow through hole bored in the brush-retaining portion 28*a*. A pair of second brushes 30*a*, 30*a* are supported by the respective hollow sleeves so as to be axially slidable. The tips of second brushes 30*a*, 30*a* are kept in sliding-contact (abutted-engagement or electric-contact) with respective slip rings 26*a* and 26*b*.

Each of second brushes 30*a*, 30*a* is formed into a substantially rectangular parallelopiped shape. A second coil spring 32*a* is disposed between the downward terminal exposed to the bottom of the upper cylindrical-hollow through hole of brush-retaining portion 28*a* and the associated second brush 30*a* under preload. In a similar manner, a second coil spring 32*a* is disposed between the downward terminal exposed to the bottom of the lower cylindrical-hollow through hole of brush-retaining portion 28*a* and the associated second brush 30*a* under preload. Thus, the tips of second brushes 30*a*, 30*a* are permanently forced or biased toward respective slip rings 26*a* and 26*b* by the spring forces of second coil springs 32*a*, 32*a*.

Additionally, a flexible pig-tale harness 33 is connected between the square base of second brush 30*a* and the downward terminal 31*a* exposed to the bottom of the upper cylindrical-hollow through hole of brush-retaining portion 28*a* by welding, to provide electric connection. In a similar manner, a flexible pig-tale harness 33 is electrically connected between the square base of second brush 30*a* and the downward terminal 31*a* exposed to the bottom of the lower cylindrical-hollow through hole of brush-retaining portion 28*a* by welding, to provide electric connection. The lengths of pig-tale harnesses 33, 33 are set to appropriate lengths sufficient to restrict maximum sliding movements (maximum axially-extended positions) of second brushes 30*a*, 30*a* relative to sleeves 29*a*-29*b* for preventing the second brushes 30*a*, 30*a* from falling out of the respective sleeves 29*a*-29*b* by the spring forces of coil springs 32*a*, 32*a*.

An annular seal member 34 is interleaved between the outer periphery of the root (the basal end) of brush-retaining portion 28*a* and an annular groove formed in the opening end of the cylindrical wall portion 3*c* of cover main body 3*a*.

As seen in FIG. 4, each of the diametrically-opposed tab-like brackets 28*c*, 28*c* is formed into a substantially triangular shape, and formed with a bolt insertion hole (a through hole) 28*e*. Thus, brush retainer 28 is fixedly connected to the cover main body 3*a* by means of bolts (not shown), which are inserted through the respective bolt insertion holes of tab-like brackets 28*c*, 28*c* and screwed into respective female screw-threads (not shown) formed in the cover main body 3*a*.

The previously-discussed motor output shaft 13 and eccentric shaft 39 are rotatably supported by means of the small-diameter ball bearing 37 and the needle bearing 38. Small-diameter ball bearing 37 is installed on the outer peripheral surface of the root of the shank 10*b* near the head 10*a* of cam bolt 10. On the other hand, needle bearing 38 is mounted on the outer peripheral surface of cylindrical portion 9*b* of driven member 9, and arranged in close proximity to the right-hand side end (viewing FIG. 3) of small-diameter ball bearing 37 such that these bearings 37-38 are juxtaposed to each other.

Needle bearing 38 is comprised of a cylindrical retainer 38*a* press-fitted into the inner peripheral surface of eccentric shaft 39 and a plurality of needle rollers 38*b* (rolling elements) rotatably retained inside of the retainer 38*a*. Each of needle rollers 38*b* is in rolling-contact with the outer peripheral surface of cylindrical portion 9*b* of driven member 9.

The inner ring of small-diameter ball bearing 37 is retained between the annular front end face of cylindrical portion 9*b* of driven member 9 and the annular washer 10*c* of cam bolt 10. On the other hand, the outer ring of small-diameter ball bearing 37 is press-fitted to the stepped portion defined between the small-inside-diameter section and the large-inside-diameter section of eccentric shaft 39, in a manner so as to be axially positioned in place by abutment with the inside annular face of the stepped portion of eccentric shaft 39.

A small-diameter oil seal (a seal member) 46 is interleaved between the outer peripheral surface of large-diameter portion 13*a* of motor output shaft 13 (eccentric shaft 39) and the inner peripheral surface of axially-leftward extending cylindrical portion 5*c* of housing 5, for preventing leakage of lubricating oil from the inside of speed reducer 8 toward the inside of electric motor 12.

The control unit (not shown) includes an input/output interface (I/O), memories (RAM, ROM), and a microprocessor or a central processing unit (CPU). The input/output interface (I/O) of the control unit receives input information from various engine/vehicle sensors, namely, a crank angle sensor, a cam shaft angle sensor, an airflow meter, an engine temperature sensor (an engine coolant temperature sensor), an accelerator opening sensor, and the like. Within the control unit, the CPU allows the access by the I/O interface of input informational data signals from the engine/vehicle sensors. The CPU is responsible for carrying the engine control program (i.e., the ignition-timing/throttle/fuel-injection/valve-timing control program) stored in memories, and is capable of performing necessary arithmetic and logic operations, depending on the current engine/vehicle operating condition, determined based on latest up-to-date informational data signals from the engine/vehicle sensors. Computational results (arithmetic calculation results), that is, calculated output signals are relayed through the output interface circuitry of the control unit to output stages (actuators), for electronic spark control, control of an electronically-controlled throttle valve, control of the fuel-injection system, and control of the VTC system. Concretely, the control unit is configured to detect an actual relative phase of intake camshaft 02 to sprocket 1 responsively to input informational signals from the crank angle sensor and the cam angle sensor and also configured to determine a desired relative phase of intake camshaft 02 to sprocket 1 depending on the current engine/vehicle operating condition. The control unit is further configured to perform rotational speed control of motor output shaft 13 by controlling electric-current supply to the electromagnetic coil 18 of electric motor 12. The rotational speed of motor output shaft 13 is reduced by means of the speed reducer 8. In this manner, the actual relative phase of intake camshaft 02 to sprocket 1 can be controlled and brought closer to the desired value.

As seen from the cross sections of FIGS. 3 and 5, and the perspective disassembled view of FIG. 4, speed reducer 8 is mainly comprised of the eccentric shaft 39 (constructing a part of the eccentric rotation member) that performs eccentric rotary motion, a middle-diameter ball bearing 47 (constructing the remainder of the eccentric rotation member) installed on the outer periphery of eccentric shaft 39, a plurality of rollers (serving as rolling elements) 48 rotatably installed on the outer periphery of middle-diameter ball bearing 47 and circumferentially arranged substantially at regular intervals, the cage 41 configured to partition, retain and guide these rollers 48, kept in rolling-contact with an outer ring 47*b* (described later) of middle-diameter ball bearing 47, in the circumferential direction by respective roller-holding holes 41*b* (in other words, respective axially-protruding lugs), while permitting a slight radial displacement (a slight oscillating motion) of each of rollers 48, and the driven member 9 formed integral with the cage 41, and the internal-tooth structural member 19 with the waveform internal toothed portion 19*a*.

Eccentric shaft 39 is formed into a shouldered cylindrical-hollow shape. Eccentric shaft 39 is constructed by a small-diameter portion 39*a* (at the front end) and a large-diameter portion 39*b* (at the rear end). The small-diameter portion 39*a* of eccentric shaft 39 is press-fitted into the inner peripheral surface of large-diameter portion 13*a* of motor output shaft 13. The large-diameter portion 39*b* of eccentric shaft 39 is a substantially cylindrical cam. The geometric center "Y" of the cam contour surface of the outer periphery of large-diameter portion 39*b* of eccentric shaft 39 is slightly displaced from the axis "X" (i.e., the rotation center "X" shown in FIGS. 3 and 5) of motor output shaft 13 in the radial direction.

As viewed from the longitudinal cross section of FIG. 3, middle-diameter ball bearing 47 is comprised of an inner ring 47*a*, the outer ring 47*b*, and balls 47*c* rotatably disposed and confined between them. The inner ring 47*a* of ball bearing 47 is press-fitted onto the outer peripheral surface (i.e., the eccentric-cam contour surface) of large-diameter portion 39*b* of eccentric shaft 39 in a manner so as to be axially positioned in place. In contrast to the inner ring 47*a*, the outer ring 47*b* is not securely fixed in the axial direction. That is, the outer ring 47*b* is free and therefore is able to move contact-free. Concretely, the left-hand sidewall (viewing FIG. 3) of the outer ring 47*b*, facing the electric-motor side, is kept out of contact with the housing 5 of electric motor 12, while the right-hand sidewall of the outer ring 47*b*, axially opposed to the annular bottom of cage 41, is kept out of contact with the inside wall surface of the annular bottom of cage 41. More concretely, a very small axial clearance "Caxial" is defined between the right-hand sidewall of the outer ring 47*b* and the inside wall surface of the annular bottom of cage 41, axially opposed to each other. Rollers 48, interleaved between the outer periphery of outer ring 47*b* of middle-diameter ball bearing 47 and the waveform internal toothed portion 19*a* of internal-tooth structural member 19, are held in rolling-contact with the outer peripheral surface of outer ring 47*b*. A crescent-shaped annular clearance "Cannular" is defined between the outer peripheral surface of outer ring 47*b* and the substantially comb-tooth shaped protruding portion (the substantially cylindrical portion 41*a*) of cage 41. Owing to eccentric rotary motion of eccentric shaft 39, middle-diameter ball bearing 47 is radially moved or displaced by virtue of the crescent-shaped annular clearance "Cannular". That is, the crescent-shaped annular clearance "Cannular" permits a slight radial displacement (a slight oscillating motion) of middle-diameter ball bearing 47.

Each of rollers 48 is made from iron-based metal material, and formed as a cylindrical solid roller. Owing to the eccentric displacement (oscillating motion) of middle-diameter ball bearing 47, the radially-inward contact surface of each of rollers 48, included within a given area, is brought into abutment (rolling-contact) with the outer peripheral surface of the outer ring 47*b* of middle-diameter ball bearing 47. On the other hand, the radially-outward contact surfaces of some of rollers, associated with the given area, are fitted into some troughs of internal teeth 19*a* of internal-tooth structural member 19 (serving as a toothed wheel or a toothed gear). That is, in the eccentric position of the eccentric rotation member (namely, the middle-diameter ball bearing 47 and eccentric shaft 39) shown in FIG. 5, roller 48, located at the 12 o'clock position, is brought into completely fitted-engagement (full tooth engagement) with the inner face of the trough between the uppermost two adjacent internal teeth 19*a*, 19*a*. In contrast, roller 48, located at the 6 o'clock position, is brought out of engagement. That is, owing to the eccentric displacement (oscillating motion) of the eccentric rotation member (i.e., the middle-diameter ball bearing 47 and eccentric shaft 39), rollers 48 can radially oscillate, while being circumferentially guided by respective axially-protruding lugs (respective roller-holding holes 41*b*) of cage 41.

To ensure smooth operation of the electric-motor-driven phase-converter equipped VTC apparatus, lubricating oil is supplied into the internal space of speed reducer 8 by lubricating-oil supply means. As shown in FIG. 3, the lubricating-oil supply means is comprised of an annular oil supply passage (not numbered), which is annularly grooved in the outer periphery of the journal of intake camshaft 02 rotatably supported by camshaft-journal bearing members 06 mounted on the cylinder head 01 and to which lubricating oil is supplied from a main oil gallery (not shown), an axial oil supply hole 51, a small-diameter axial oil hole 52, and large-diameter oil drain holes (not shown). Axial oil supply hole 51 is formed in the front end of intake camshaft 02 to communicate the annular oil supply passage via an oil groove, cut in the front end face of intake camshaft 02 and configured to communicate the downstream end of axial oil supply hole 51. Small-diameter axial oil hole 52 is formed as a through hole in the driven member 9, such that one end of small-diameter axial oil hole 52 is opened into the axial oil supply hole 51 through the oil groove cut in the camshaft end face and the other end of small-diameter axial oil hole 52 is opened into the internal space defined near both the needle bearing 38 and the middle-diameter ball bearing 47. Large-diameter oil drain holes (not shown) are formed in the driven member 9 as oil outlets.

During operation, lubricating oil is constantly fed from the discharge port of an oil pump (not shown) into the oil supply hole 51 via the main oil gallery formed in the cylinder head. Hence, by the previously-discussed lubricating-oil supply means, lubricating oil can be fed via the oil supply hole 51 to the internal space 44 and stays in the internal space 44. Then, the lubricating oil is supplied from the internal space 44 to moving parts, namely, middle-diameter ball bearing 47 and rollers 48 for lubrication, and further flows into the eccentric shaft 39 and the internal space of motor output shaft 13, for lubrication of moving parts, such as needle bearing 38 and small-diameter ball bearing 37. By the way, undesirable leakage of lubricating oil, staying in the internal space 44, to the inside of the electric-motor housing 5 can be prevented or adequately suppressed by means of the small-diameter oil seal 46.

The fundamental operation of intake VTC 04 incorporated in the VTC system of the embodiment is hereunder described in detail.

When the engine crankshaft rotates, sprocket 1 rotates in synchronism with rotation of the crankshaft through the timing chain (not shown). On one hand, torque flows from the sprocket 1 through the internal-tooth structural member 19 via the annular female screw-threaded member 6 to the housing 5 of electric motor 12, and thus permanent magnets 14-15 and stator 16, all attached to the inner periphery of housing 5, rotate together with the housing 5. On the other hand, torque flows from the sprocket 1 through the internal-tooth structural member 19 via the rollers 48, cage 41, and driven member 9 to the intake camshaft 02. Thus, intake camshaft 02 is rotated to operate (open/close) the intake valves against the spring forces of the valve springs by the intake-valve cams.

During a given engine operating condition after the engine start-up, an electric current is applied from the control unit through the terminal strips 31, 31, pig-tale harnesses 33, 33, second brushes 30*a*, 30*a*, and slip rings 26*a*-26*b* to the electromagnetic coil 18 of electric motor 12. Hence, motor output shaft 13 is driven. Then, the output rotation from the motor output shaft 13 is reduced by means of the speed reducer 8, and thus the reduced motor speed (in other words, the multiplied motor torque) is transmitted to the intake camshaft 02.

That is, when eccentric shaft 39 rotates eccentrically during rotation of motor output shaft 13, each of rollers 48 moves (rolls) and relocates from one of two adjacent internal teeth 19*a*, 19*a* to the other with one-tooth displacement per one complete revolution of motor output shaft 13, while being held in rolling-contact with the outer ring 47*b* of middle-diameter ball bearing 47 and simultaneously radially guided by the associated axially-protruding lug (the associated roller-holding hole 41*b*) of cage 41. By way of the repeated relocations of each of rollers 48 every revolutions of motor output shaft 13, rollers 48 move in the circumferential direction with respect to the waveform internal toothed portion 19*a* of internal-tooth structural member 19, while being held in rolling-contact with the outer ring 47*b* of middle-diameter ball bearing 47. In this manner, torque is transmitted through the driven member 9 to the intake camshaft 02, while the rotational speed of motor output shaft 13 is reduced. The reduction ratio of this type of speed reducer 8 can be determined by the number of rollers 48, in other words, the number of roller-holding holes 41*b* (i.e., the number of axially-protruding lugs of cage 41). The fewer the number of rollers 48, the lower the reduction ratio. That is, the reduction ratio can be arbitrarily set depending on the number of rollers 48.

As discussed above, by execution of rotational speed control of motor output shaft 13, intake camshaft 02 is rotated in a normal-rotational direction or in a reverse-rotational direction with respect to the sprocket 1, and thus an angular phase of intake camshaft 02 relative to sprocket 1 is changed, and as a result intake valve open timing (IVO) and intake valve closure timing (IVC) can be phase-advanced or phase-retarded.

As discussed above, the speed reducer 8, incorporated in the intake VTC 04, is configured such that the rotational speed of motor output shaft 13 of electric motor 12 can be reduced by virtue of the repeated relocations of each of rollers 48 every revolutions of motor output shaft 13, rollers 48 moving in the circumferential direction with respect to the waveform internal toothed portion 19*a* of internal-tooth structural member 19, while being held in rolling-contact with the outer ring 47*b* of middle-diameter ball bearing 47. Hence, as seen from the characteristic diagram of FIG. 11, a friction F1 of intake VTC 04 during operation (in other words, during speed-reduction of the roller speed reducer 8) becomes adequately reduced. Thus, it is possible to enhance or improve the phase-conversion responsiveness for the angular phase shift of intake camshaft 02 relative to sprocket 1 in the phase-advance direction or in the phase-retard direction.

As clearly shown in FIG. 6, the clockwise rotary motion (normal-rotational motion) of intake camshaft 02 relative to sprocket 1 is restricted by abutment between the counterclockwise edge of stopper 61*b* and the clockwise edge 2*c* of stopper groove 2*b*. On the other hand, the counterclockwise rotary motion (reverse-rotational motion) of intake camshaft 02 relative to sprocket 1 is restricted by abutment between the clockwise edge of stopper 61*b* and the counterclockwise edge 2*d* of stopper groove 2*b*.

[Exhaust VTC]

As shown in FIGS. 1 and 8-10, the above-mentioned exhaust VTC 05 is comprised of a driving rotary member 70 that rotates in synchronism with rotation of the engine crankshaft, and a phase change mechanism (a phase converter) 71 installed between the driving rotary member 70 and the exhaust camshaft 03 for changing a relative angular phase between the driving rotary member 70 and the exhaust camshaft 03 depending on an engine operating condition.

Driving rotary member 70 is comprised of a sprocket 75 and a gear member 80 formed into a substantially cylindrical shape with an annular bottom. The sprocket 75 and the gear member 80 are integrally connected to each other by axially fastening them together with bolts.

Phase converter 71 is mainly constructed by the electric motor 72, an electric-motor energization control circuit 73, and a planetary-gear speed reducer 74 provided for reducing the rotational speed of a motor output shaft 72*a* of electric motor 72 and for transmitting the reduced motor speed to the exhaust camshaft 03. Electric motor 72 and electric-motor energization control circuit 73 serve as a phase-control torque generating system.

For instance, electric motor 72 is a brushless motor. The control torque to be applied to the motor output shaft 72*a* is generated by energizing a coil of electric motor 72. Energization control circuit 73 is constructed by a microcomputer, a motor driver, and the like, and located outside of the electric motor 72. Energization control circuit 73 is electrically connected to the electric motor 72, for controlling energization of electric motor 72 depending on the engine operating condition. In accordance with the controlled energization mode, electric motor 72 is driven so as to hold, increase, or decrease the control torque applied to the motor output shaft 72*a*.

Planetary-gear speed reducer 74 is comprised of a driven rotary member 76, a substantially cylindrical-hollow planet carrier 77, elastic members (resilient members) 78, 78, and a planet rotor 79.

The peripheral wall section of gear member 80 is formed with a driving internal toothed portion 81 whose addendum circle is located radially inside of a root circle. Sprocket 75 has a plurality of radially-outward protruding teeth 75*a*. The timing chain (not shown) is wound on both the teeth 75*a* of sprocket 75 and a plurality of teeth of the sprocket on the crankshaft, such that torque from the crankshaft is transmitted to the sprocket 75. Therefore, when the output torque from the crankshaft is inputted through the timing chain to the sprocket 75, sprocket 75 rotates in synchronism with rotation of the crankshaft, while holding the angular phase of the sprocket 75 relative to the crankshaft. At this time, the direction of rotation of sprocket 75 becomes a counterclockwise direction in FIGS. 9-10.

Figure 8:
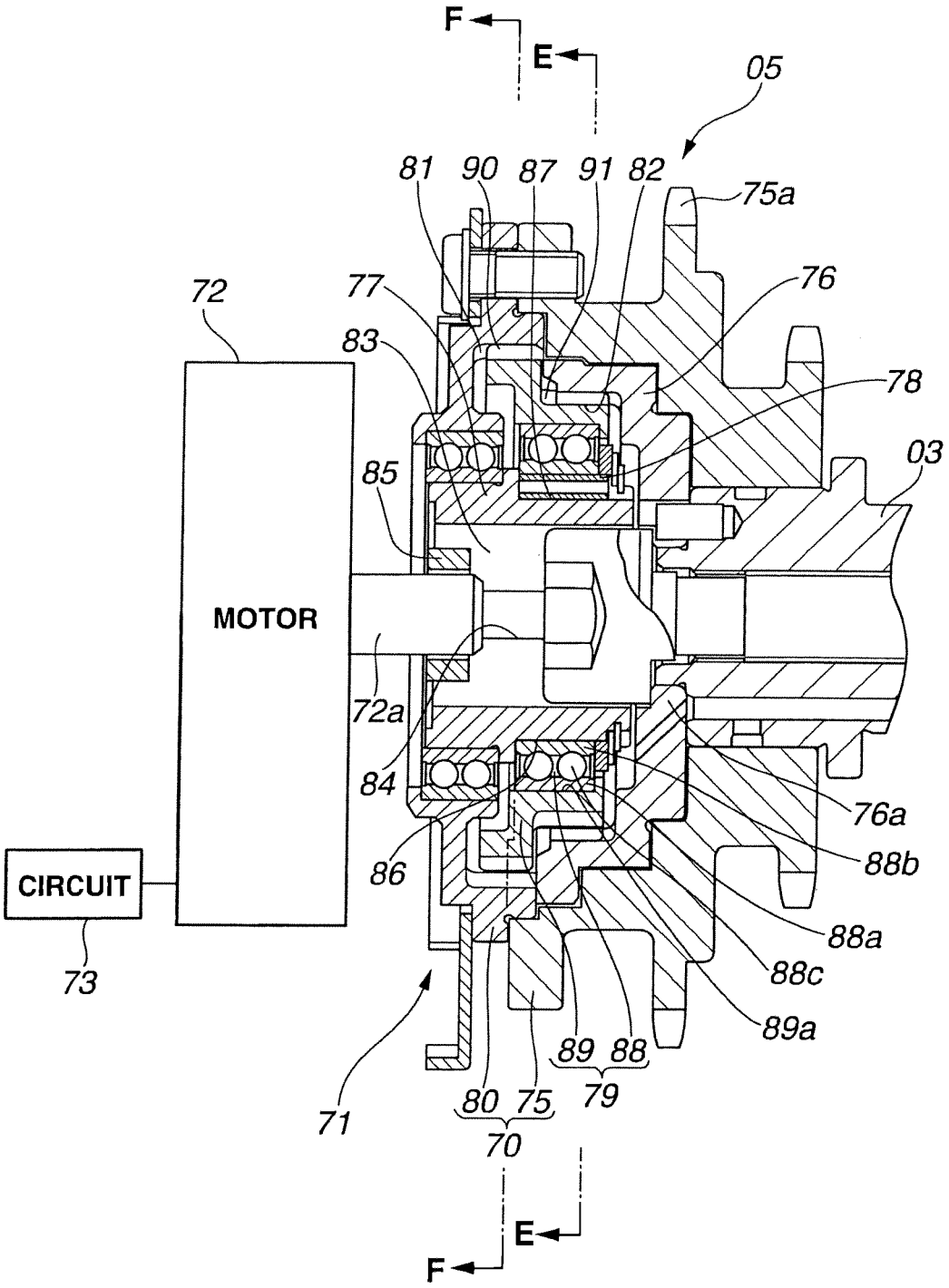
FIG. 8 is a longitudinal cross-sectional view illustrating an exhaust VTC device of the first embodiment.
Figure 9:
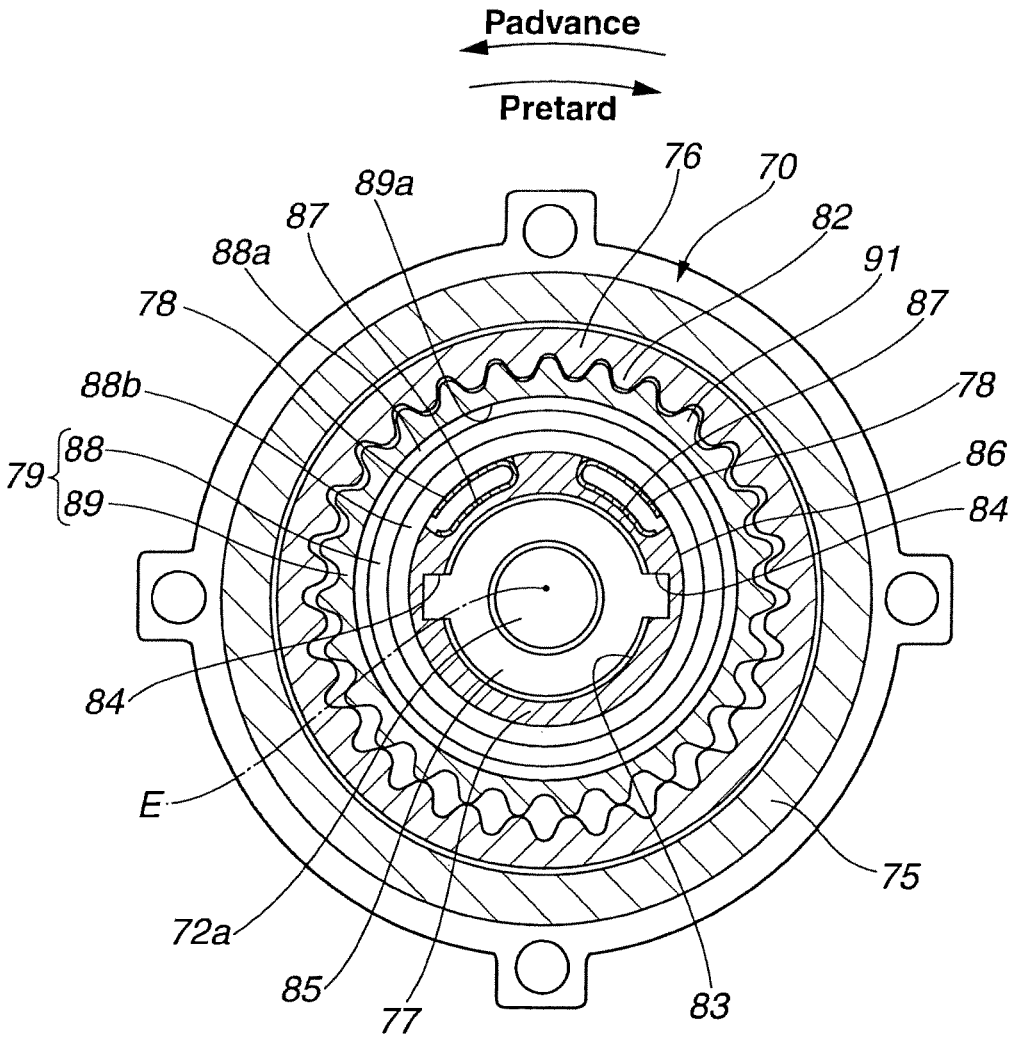
FIG. 9 is a lateral cross section taken along the line E-E of FIG. 8.
Figure 10:
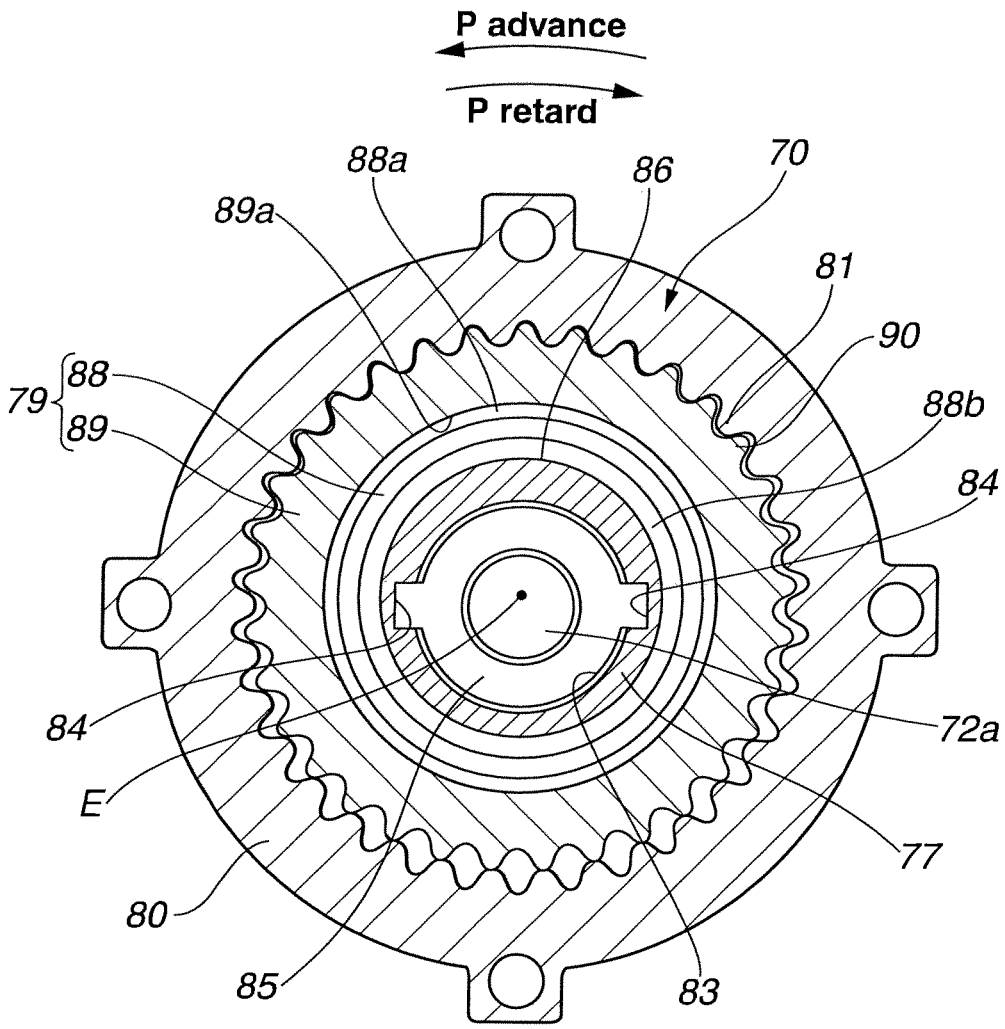
FIG. 10 is a lateral cross section taken along the line F-F of FIG. 8.

As shown in FIGS. 9-10, the driven rotary member 76 of planetary-gear speed reducer 74 is formed into a substantially cylindrical shape with an annular bottom. As clearly shown in FIG. 8, driven rotary member 76 is fitted to the inner periphery of sprocket 75. The peripheral wall section of driven rotary member 76 is formed with a driven internal toothed portion 82 whose addendum circle is located radially inside of a root circle. As seen from the longitudinal cross section of FIG. 8, the driven internal toothed portion 82 is configured to be displaced axially rightward from the driving internal toothed portion 81, and the geometric center of driven internal toothed portion 82 and the geometric center of driving internal toothed portion 81 are arranged coaxially with each other. The diameter (exactly, the pitch-circle diameter) of driven internal toothed portion 82 is dimensioned to be less than that of driving internal toothed portion 81, and the module of driven internal toothed portion 82 and the module of driving internal toothed portion 81 are the same. Thus, the number of teeth of driven internal toothed portion 82 is fewer than that of driving internal toothed portion 81.

As shown in FIG. 8, the annular bottom wall of driven rotary member 76 is formed with a coupling section 76*a* which is coaxially arranged and fixedly connected to the front end of exhaust camshaft 03. Hence, driven rotary member 76 is able to rotate in synchronism with rotation of exhaust camshaft 03, while holding the angular phase of the driven rotary member 76 relative to the exhaust camshaft 03 constant. Additionally, driven rotary member 76 is configured such that relative rotation of driven rotary member 76 with respect to sprocket 75 is permitted.

By the way, in FIGS. 9-10, the direction "Padvance" indicates a relative-rotation direction in which driven rotary member 76 is phase-advanced with respect to the sprocket 75, whereas the direction "Pretard" indicates a relative-rotation direction in which driven rotary member 76 is phase-retarded with respect to the sprocket 75.

As shown in FIGS. 8-10, the inner peripheral portion of the cylindrical-hollow planet carrier 77 is configured to define an input portion 83 to which the control torque is inputted from the motor output shaft 72*a* included in the phase-control torque generating system.

Input portion 83 is arranged coaxially with respect to the geometric center of driving internal toothed portion 81, the geometric center of driven internal toothed portion 82, and the axis of motor output shaft 72*a*. Input portion 83 has at least two grooves 84 (i.e., radially-inward cutouts or openings). Planet carrier 77 has a joint 85 which is fitted to the grooves 84. By virtue of the joint 85 fitted to the grooves 84, planet carrier 77 is mechanically connected to the motor output shaft 72*a*. Hence, planet carrier 77 is able to rotate together with the motor output shaft 72*a*. Additionally, planet carrier 77 is configured such that relative rotation of planet carrier 77 with respect to each of driving rotary member 70 (i.e., gear member 80 and sprocket 75) and driven rotary member 76 of planetary-gear speed reducer 74 is permitted.

Part (the right-hand half, viewing FIG. 8) of the outer peripheral portion of the cylindrical-hollow planet carrier 77 is configured as an eccentric portion 86 whose geometric center (an eccentricity axis "E") deviates from the geometric center of driving internal toothed portion 81 (that is, the geometric center of driven internal toothed portion 82). Eccentric portion 86 has a pair of recesses 87 (i.e., two radially-outward cutouts or openings). As best seen in FIG. 9, the previously-discussed resilient members 78, 78 are accommodated in respective recesses 87, 87.

Planet rotor 79 is constructed by combining a planetary bearing 88 and a planetary gear 89. Planetary bearing 88 is a radial bearing comprised of an outer ring 88*a*, an inner ring 88*b*, and ball rolling elements 88*c* confined between outer and inner rings 88*a*-88*b*.

In the shown embodiment, the outer ring 88*a* is concentrically press-fitted onto the inner periphery of the center bore

89*a* of planetary gear 89. On the other hand, the inner ring 88*b* is concentrically fitted onto the outer periphery of eccentric portion 86 of planet carrier 77. With this arrangement, planetary bearing 88 is supported by the planet carrier 77 from the inner peripheral side of planetary bearing 88. Additionally, planetary bearing 88 is configured to exert restoring forces, which are applied from respective resilient members 78, 78, on the center bore 89*a* of planetary gear 89.

Planetary gear 89 is formed into a stepped cylindrical shape, and arranged concentrically with the eccentric portion 86. Thus, planetary gear 89 is arranged eccentrically to both the geometric center of driving internal toothed portion 81 and the geometric center of driven internal toothed portion 82. Planetary gear 89 has a large-diameter section and a small-diameter section, which are integrally formed with each other and configured to respectively define a driving external toothed portion 90 and a driven external toothed portion 91, each having an addendum circle located radially outside of a root circle. The numbers of the external teeth of the driving external toothed portion 90 and the driven external toothed portion 91 are respectively set to be smaller than the numbers of the internal teeth of the driving internal toothed portion 81 and the driven internal toothed portion 82 by the same tooth number. Actually, in the shown embodiment, the driving external toothed portion 90 has one fewer external teeth than the number of internal teeth of driving internal toothed portion 81 (see FIG. 10). In a similar manner, the driven external toothed portion 91 has one fewer external teeth than the number of internal teeth of driven internal toothed portion 82 (see FIG. 9). The module of driven external toothed portion 91 and the module of driving external toothed portion 90 are the same. Thus, the number of teeth of driven external toothed portion 91 is fewer than that of driving external toothed portion 90.

As appreciated from the cross section of FIG. 10, driving external toothed portion 90 is meshed with the driving internal toothed portion 81 on the inner periphery of driving internal toothed portion 81. As seen from the longitudinal cross section of FIG. 8, the driven external toothed portion 91 is configured to be displaced axially rightward from the driving external toothed portion 90, and the geometric center of driven external toothed portion 91 and the geometric center of driving external toothed portion 90 are arranged coaxially with each other. As appreciated from the cross section of FIG. 9, driven external toothed portion 91 is meshed with the driven internal toothed portion 82 on the inner periphery of driven internal toothed portion 82. The geometric center of driven external toothed portion 91 and the geometric center of driving external toothed portion 90 correspond to the eccentricity axis "E" of eccentric portion 86 of planet carrier 77. Hence, planetary gear 89 can perform a planetary motion so as to revolve in the direction of rotation of eccentric portion 86, while revolving on the eccentricity axis "E" of driving external toothed portion 90 (i.e., the eccentricity axis "E" of driven external toothed portion 91). As appreciated from the cross sections of FIGS. 9-10, planetary-gear speed reducer 74 is a cycloid planetary-gear speed reducer.

Phase converter 71, configured as previously discussed, changes an angular phase of exhaust camshaft 03 relative to sprocket 75 depending on the control torque inputted from the motor output shaft 72*a* to the input portion 83 of planet carrier 77, thereby achieving exhaust-valve timing (exhaust-valve open timing EVO and exhaust-valve closure timing EVC) suited to the engine operating condition.

Concretely, when planet carrier 77 does not rotate relatively to the sprocket 75 due to the control torque held constant, the driving external toothed portion 90 and the driven external toothed portion 91 of planetary gear 89 rotate together with respective rotary members 70 and 76, while holding the meshed positions thereof with the internal toothed portions 81 and 82, respectively. Thus, the relative angular phase between the sprocket 75 and the exhaust camshaft 03 does not change and as a result the exhaust valve timing is held constant.

When planet carrier 77 rotates relatively to the sprocket 75 in the direction "Padvance" responsively to an increase in the control torque in the direction "Padvance", the driving external toothed portion 90 and the driven external toothed portion 91 of planetary gear 89 unitarily perform the planetary motion, while changing the meshed positions with the internal toothed portions 81 and 82, respectively. Thus, driven rotary member 76 rotates relatively to the sprocket 75 in the direction "Padvance". Accordingly, the angular phase of exhaust camshaft 03 relative to sprocket 75 changes toward the phase-advance side and as a result the exhaust valve timing is controlled to the phase-advance side.

Conversely when planet carrier 77 rotates relatively to the sprocket 75 in the direction "Pretard" responsively to an increase in the control torque in the direction "Pretard", the driving external toothed portion 90 and the driven external toothed portion 91 of planetary gear 89 unitarily perform the planetary motion, while changing the meshed positions with the internal toothed portions 81 and 82, respectively. Thus, driven rotary member 76 rotates relatively to the sprocket 75 in the direction "Pretard". Accordingly, the angular phase of exhaust camshaft 03 relative to sprocket 75 changes toward the phase-retard side and as a result the exhaust valve timing is controlled to the phase-retard side.

As discussed above, exhaust VTC 05 is configured such that driven rotary member 76 (i.e., exhaust camshaft 03) rotates relatively to sprocket 75 by virtue of the planetary motion of planetary gear 89 with changes in the meshed positions of the external toothed portions 90 and 91 with the respective internal toothed portions 81 and 82, occurring due to an increase in the control torque of motor output shaft 72*a* in the direction "Padvance" or in the direction "Pretard". That is to say, exhaust VTC 05 is configured such that relative rotation of driven rotary member 76 (i.e., exhaust camshaft 03) to sprocket 75 occurs by virtue of both the meshed-engagement of driving external toothed portion 90 with driving internal toothed portion 81 and the meshed-engagement of driven external toothed portion 91 with driven internal toothed portion 82. Hence, as seen from the characteristic diagram of FIG. 11, a friction F2 of the exhaust VTC 05 during operation (in other words, during speed-reduction of the planetary-gear speed reducer 74) becomes comparatively greater. Thus, on one hand, the phase-conversion responsiveness for the angular phase shift of exhaust camshaft 03 relative to sprocket 75 in the phase-advance direction or in the phase-retard direction tends to deteriorate. On the other hand, the phase holding performance for the phase angle of exhaust camshaft 03 relative to sprocket 75 can be improved by the comparatively greater friction F2 of the exhaust VTC 05.

In the first embodiment as explained previously in reference to FIGS. 1-11, regarding the intake VTC 04, the speed reducer 8 is configured such that the rotational speed of electric motor 12 can be reduced by virtue of the repeated relocations of each of rollers 48 every revolutions of motor output shaft 13, rollers 48 moving in the circumferential direction with respect to the waveform internal toothed portion 19*a*, while being held in rolling-contact with the ball-bearing outer ring 47*b*. Hence, as seen from the characteristic diagram of FIG. 11, the friction F1 of intake VTC 04 during speed-reduction of the roller speed reducer 8 becomes adequately reduced, thereby improving the phase-conversion responsiveness for the angular phase shift of intake camshaft 02 relative to sprocket 1 in the phase-advance direction or in the phase-retard direction.

Figure 11:
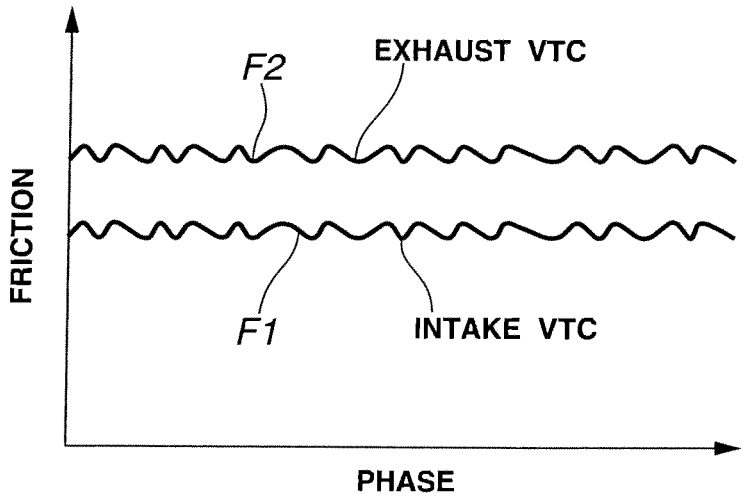
FIG. 11 is a characteristic diagram illustrating the difference between a friction of the intake VTC device and a friction of the exhaust VTC device in the first embodiment.

In contrast, regarding the exhaust VTC 05, as seen from the characteristic diagram of FIG. 11, the friction F2 of exhaust VTC 05, caused by both the meshed-engagement of driving external toothed portion 90 with driving internal toothed portion 81 and the meshed-engagement of driven external toothed portion 91 with driven internal toothed portion 82, becomes greater than the friction F1 of intake VTC 04, thereby improving the phase holding performance for stably holding the phase angle of exhaust camshaft 03 relative to sprocket 75.

Therefore, according to the valve timing control system of the first embodiment, it is possible to reconcile and balance two contradictory requirements, namely, the improved operational responsiveness of intake VTC 04 for the angular phase shift of intake camshaft 02 relative to sprocket 1 in the phase-advance direction or in the phase-retard direction by virtue of the roller speed reducer 8, and the improved phase holding performance of exhaust VTC 05 for stably holding the phase angle of exhaust camshaft 03 relative to sprocket 75 by virtue of the planetary-gear speed reducer 74.

Second Embodiment

Figure 12:
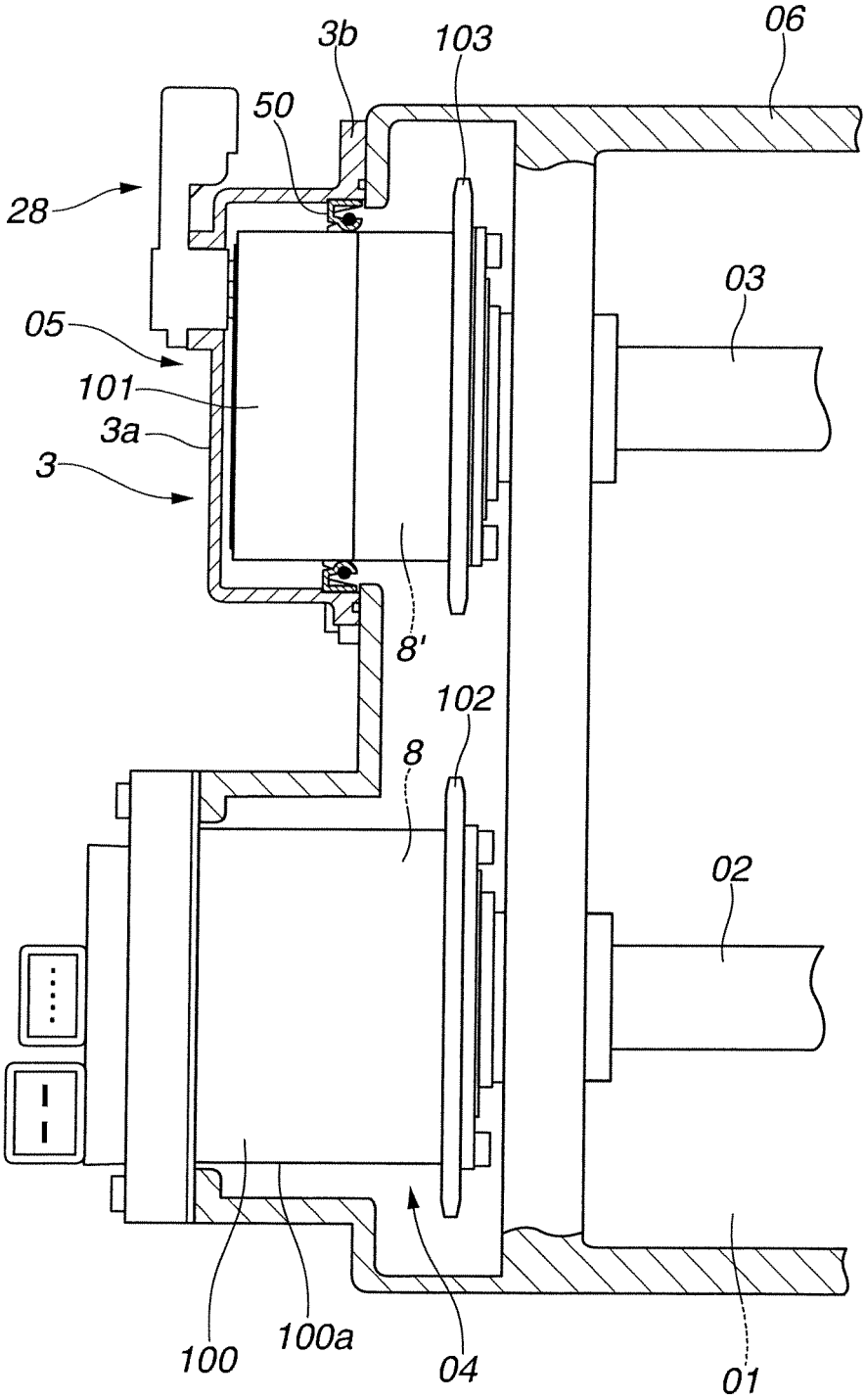
FIG. 12 is a plan view illustrating the essential part of the second embodiment of a valve timing control system.

Referring now to FIG. 12, there is shown the essential part of the valve timing control system of the second embodiment. The VTC system of the second embodiment differs from the first embodiment, in that in the second embodiment the roller speed reducer 8 is applied to the intake VTC 04 and a roller speed reducer 8' similar to the roller speed reducer 8 incorporated in the intake VTC 04 is applied to the exhaust VTC 05. Furthermore, in contrast to the first embodiment, in the second embodiment an electric motor 100 of intake VTC 04 is constructed by a brushless motor, whereas an electric motor 101 of exhaust VTC 05 is constructed by a brush-equipped motor.

Regarding intake VTC 04, a housing 100*a* of electric motor 100 is fixedly connected to a sprocket 102, to which torque is transmitted from the crankshaft, by means of bolts, such that the housing 100*a* always rotates in synchronism with rotation of the sprocket 102.

Regarding exhaust VTC 05, electric motor 101 is not directly connected to a sprocket 103. That is, motor 101 is configured so as not to be affected by rotation of sprocket 103.

As appreciated from the above, in the intake VTC 04, housing 100*a* always rotates together with the sprocket 102 during operation of the engine, such that a dynamic friction arises. Hence, when intake camshaft 02 is rotated relatively to the sprocket 102 via the roller speed reducer 8 by rotating the electric motor 100 depending on a change in the engine operating condition, a starting speed of relative rotation of intake camshaft 02 to sprocket 102 tends to become faster, because of the dynamic friction. As a result of this, it is possible to improve the phase-conversion responsiveness for the angular phase shift of intake camshaft 02 to sprocket 102.

Additionally, in the second embodiment, electric motor 100 of intake VTC 04 is constructed by a brushless motor, which has a less sliding friction resistance in comparison with a brush-equipped motor. Therefore, by the synergistic effect of the dynamic friction and the less sliding friction, it is possible to greatly improve the operational responsiveness of intake VTC 04 for the angular phase shift of intake camshaft 02 relative to sprocket 102.

In contrast to the above, in the exhaust VTC 05, even when sprocket 103 is rotating in synchronism with rotation of the crankshaft during operation of the engine, the motor output shaft of electric motor 101 is kept in a non-rotational state, that is, remains stationary, until such time that a control signal has been outputted from the control unit to the electric motor 101. Hence, when electric motor 101 begins to operate depending on a change in the engine operating condition, on one hand, the phase-conversion responsiveness for the angular phase shift of exhaust camshaft 03 to sprocket 103 tends to deteriorate, because of a static friction resistance/drag of electric motor 101. On the other hand, by virtue of the static friction of electric motor 101, it is possible to improve the phase holding performance for the relative angular phase of exhaust camshaft 03, thereby enabling the phase angle of exhaust camshaft 03 relative to sprocket 103 to be stably held at a desired relative-rotation position.

Additionally, in the second embodiment, electric motor 101 of exhaust VTC 05 is constructed by a brush-equipped motor, and thus a sliding friction resistance acts between two surfaces of a brush and a slip ring in sliding-contact with each other. Therefore, by the synergistic effect of the static friction and the comparatively greater sliding friction, it is possible to greatly improve the phase holding performance.

Third Embodiment

Figure 13:
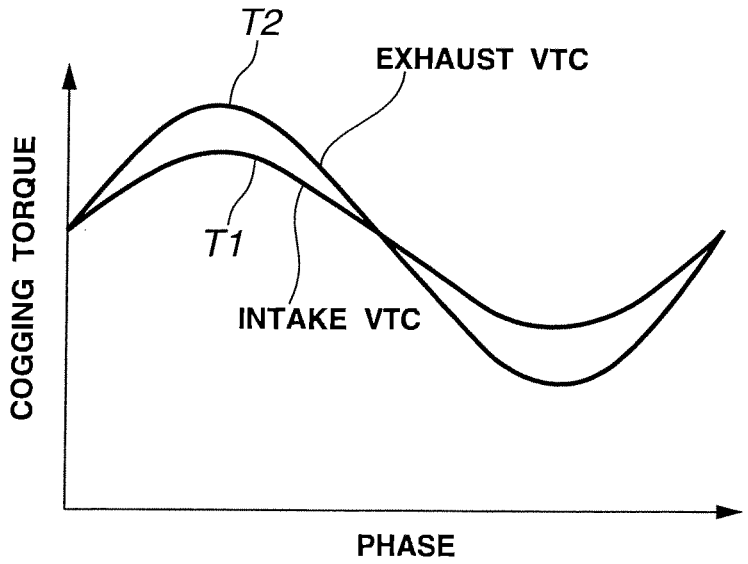
FIG. 13 is a characteristic diagram, illustrating the difference between a cogging torque of an electric motor of the intake VTC device and a cogging torque of an electric motor of the exhaust VTC device in the third embodiment.

Referring now to FIG. 13, there is shown the characteristic diagram illustrating the cogging-torque difference between a permanent-magnet electric motor applied to intake VTC 04 and a permanent-magnet electric motor applied to exhaust VTC 05 in the valve timing control system of the third embodiment. In the third embodiment, the same type of speed reducer (e.g., a roller speed reducer) as the second embodiment is used for each of intake VTC 04 and exhaust VTC 05, but a cogging-torque characteristic of the direct-current (DC) motor incorporated in the intake VTC 04 and a cogging-torque characteristic of the direct-current (DC) motor incorporated in the exhaust VTC 05 are set to be different from each other, so as to reconcile and balance two contradictory requirements, namely, the improved operational responsiveness of intake VTC 04 for the angular phase shift of the intake camshaft relative to the intake-side sprocket, and the improved phase holding performance of exhaust VTC 05 for stably holding the phase angle of the exhaust camshaft relative to the exhaust-side sprocket.

Concretely, the number of magnetic poles of the electric motor of intake VTC 04 is set to be greater than that of the electric motor of exhaust VTC 05. Hence, as appreciated from the phase versus cogging-torque characteristic diagram of FIG. 13, the cogging torque T1 of the electric motor of intake VTC 04 can be set to be less than the cogging torque T2 of the electric motor of exhaust VTC 05. As a result of this, a starting speed of rotation of the electric motor of intake VTC 04 having the relatively less cogging torque T1 tends to become faster, thus improving the phase-conversion responsiveness for the angular phase shift of the intake camshaft to the intake-side sprocket. In contrast, regarding the exhaust VTC 05, on one hand, the phase-conversion responsiveness for the angular phase shift of the exhaust camshaft to the exhaust-side sprocket tends to deteriorate, because of the relatively greater cogging torque T2. On the other hand, the phase holding performance for the phase angle of the exhaust camshaft relative to the exhaust-side sprocket can be improved by the relatively greater cogging torque T2.

As will be appreciated from the above, the invention is not limited to the particular embodiments shown and described herein, but various changes and modifications may be made. For instance, the configuration of each of electric motors to be applied to intake VTC 04 and exhaust VTC 05 and the configuration of each of speed reducers to be applied to intake VTC 04 and exhaust VTC 05 may be further modified in order to reconcile and balance two contradictory requirements, namely, the improved operational responsiveness of intake VTC 04 for the angular phase shift of the intake camshaft relative to the intake-side sprocket, and the improved phase holding performance of exhaust VTC 05 for stably holding the phase angle of the exhaust camshaft relative to the exhaust-side sprocket.

The entire contents of Japanese Patent Application No. 2013-021947 (filed Feb. 7, 2013) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve timing control system of an internal combustion engine, comprising:

an electric-motor-driven intake valve timing control device installed on an intake camshaft, the intake valve timing control device comprising:

a first electric motor provided to generate torque by energizing the first electric motor; and a first speed reducer configured to reduce a rotational speed of the first electric motor, and transmit the reduced rotational speed to the intake camshaft for changing intake valve timing; and an electric-motor-driven exhaust valve timing control device installed on an exhaust camshaft, the exhaust valve timing control device comprising:

a second electric motor provided to generate torque by energizing the second electric motor; and a second speed reducer configured to reduce a rotational speed of the second electric motor, and transmit the reduced rotational speed to the exhaust camshaft for changing exhaust valve timing, wherein the first speed reducer of the intake valve timing control device is configured to have a friction less than a friction of the second speed reducer of the exhaust valve timing control device.

2. A valve timing control system of an internal combustion engine, comprising:

an electric-motor-driven intake valve timing control device installed on an intake camshaft, the intake valve timing control device comprising:

a first electric motor provided to generate torque by energizing the first electric motor; and a first speed reducer having a first toothed gear configured to reduce a rotational speed of the first electric motor, and transmit the reduced rotational speed to the intake camshaft for changing intake valve timing; and an electric-motor-driven exhaust valve timing control device installed on an exhaust camshaft, the exhaust valve timing control device comprising:

a second electric motor provided to generate torque by energizing the second electric motor; and a second speed reducer having a second toothed gear configured to reduce a rotational speed of the second electric motor, and transmit the reduced rotational speed to the exhaust camshaft for changing exhaust valve timing, wherein the first speed reducer of the intake valve timing control device is configured to transmit torque by repeated relocations of each of rolling elements rolling and relocating from one of two adjacent teeth of the first toothed gear to the other, and the second speed reducer of the exhaust valve timing control device is configured to transmit torque by meshed-engagement of the second toothed gear with another toothed gear.

3. The valve timing control system as recited in claim 2, wherein:

the first speed reducer of the intake valve timing control device is a roller speed reducer; and the second speed reducer of the exhaust valve timing control device is a cycloid speed reducer.

4. A valve timing control system of an internal combustion engine, comprising:

an electric-motor-driven intake valve timing control device installed on an intake camshaft, the intake valve timing control device comprising:

a first electric motor provided to generate torque by energizing the first electric motor; and a first speed reducer configured to reduce a rotational speed of the first electric motor, and transmit the reduced rotational speed to the intake camshaft for changing intake valve timing; and an electric-motor-driven exhaust valve timing control device installed on an exhaust camshaft, the exhaust valve timing control device comprising:

a second electric motor provided to generate torque by energizing the second electric motor; and a second speed reducer configured to reduce a rotational speed of the second electric motor, and transmit the reduced rotational speed to the exhaust camshaft for changing exhaust valve timing, wherein a cogging torque of the first electric motor of the intake valve timing control device is set to be less than a cogging torque of the second electric motor of the exhaust valve timing control device.

5. The valve timing control system as recited in claim 4, wherein:

the number of magnetic poles of the first electric motor of the intake valve timing control device is set to be greater than that of the second electric motor of the exhaust valve timing control device.

6. A valve timing control system of an internal combustion engine, comprising:

an electric-motor-driven intake valve timing control device installed on an intake camshaft, the intake valve timing control device comprising:

a first electric motor provided to generate torque by energizing the first electric motor; and a first speed reducer configured to reduce a rotational speed of the first electric motor, and transmit the reduced rotational speed to the intake camshaft for changing intake valve timing; and an electric-motor-driven exhaust valve timing control device installed on an exhaust camshaft, the exhaust valve timing control device comprising:

a second electric motor provided to generate torque by energizing the second electric motor; and a second speed reducer configured to reduce a rotational speed of the second electric motor, and transmit the reduced rotational speed to the exhaust camshaft for changing exhaust valve timing, wherein the first electric motor of the intake valve timing control device is constructed by a brushless motor, and the second electric motor of the exhaust valve timing control device is constructed by a brush-equipped direct-current motor.

7. The valve timing control system as recited in claim 6, wherein:

the first electric motor of the intake valve timing control device is configured to always rotate together with a driving rotary member of the intake valve timing control device; and the second electric motor of the exhaust valve timing control device is configured to begin to rotate every control signal inputs for changing the exhaust valve timing.

* * * * *